US011118273B1

(12) United States Patent
Wilcox

(10) Patent No.: US 11,118,273 B1
(45) Date of Patent: Sep. 14, 2021

(54) BRINE ELECTROLYSIS SYSTEM FOR PRODUCING PRESSURIZED CHLORINE AND HYDROGEN GASES

(71) Applicant: The United States of America, as Represented by the Secretary of the Navy, Arlington, VA (US)

(72) Inventor: Benjamin Wilcox, Camarillo, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/916,320

(22) Filed: Jun. 30, 2020

Related U.S. Application Data

(63) Continuation-in-part of application No. 16/557,214, filed on Aug. 30, 2019, now Pat. No. 10,731,549.

(51) Int. Cl.

| | |
|---|---|
| ***C25B 1/46*** | (2006.01) |
| ***C25B 15/08*** | (2006.01) |
| ***C25B 15/02*** | (2021.01) |
| ***C25B 9/23*** | (2021.01) |

(52) U.S. Cl.
CPC ..... *C25B 1/46* (2013.01); *C25B 9/23* (2021.01); *C25B 15/02* (2013.01); *C25B 15/08* (2013.01)

(58) Field of Classification Search
CPC .. C25B 1/46; C25B 9/23; C25B 15/02; C25B 15/08
See application file for complete search history.

(56) References Cited

U.S. PATENT DOCUMENTS

| | | | | |
|---|---|---|---|---|
| 5,707,424 | A | 1/1998 | Tom | |
| 6,338,786 | B1 * | 1/2002 | Thorpe | C25B 9/70 205/628 |
| 6,484,491 | B1 | 11/2002 | Thordarson | |
| 7,655,063 | B2 * | 2/2010 | Wang | B01D 46/30 55/490 |
| 8,236,149 | B2 | 8/2012 | Wilson | |
| 2004/0045836 | A1 * | 3/2004 | Tseng | C02F 1/4618 205/620 |
| 2005/0217991 | A1 | 10/2005 | Dahlquist | |
| 2007/0084728 | A1 | 4/2007 | Martez | |
| 2010/0236922 | A1 * | 9/2010 | Meneghini | C25B 13/08 204/296 |

(Continued)

*Primary Examiner* — Stephen P Avila
(74) *Attorney, Agent, or Firm* — Naval Air Warfare Center Weapons Division; Jimmy M. Seuz

(57) ABSTRACT

A brine electrolysis system for producing pressurized chlorine and hydrogen gases. In its basic configuration, the brine electrolysis system may comprise: two liquid storage tanks for storing two liquid reactants; a tank having two interior spaces separated by a diaphragm for receiving the liquid reactants; two pumps for regulating the flow of the liquid reactants from the liquid storage tanks to the interior spaces of the tank, two open-bottom cylinders for storing and dispensing two gases; an electrolysis stack assembly for converting the liquid reactants into two gases; and two submersible pumps for pumping each liquid reactant into an electrolysis stack assembly. Each open-bottom cylinder may comprise a float sensor for determining the amount of fluid entering its cylindrical space. The system may further comprise controllers for regulating ionic concentrations within the two interior spaces. Dispense lines and valves may be utilized to release the gases.

20 Claims, 8 Drawing Sheets

(56) References Cited

U.S. PATENT DOCUMENTS

| | | | | |
|---|---|---|---|---|
| 2010/0275858 | A1 | 11/2010 | Jeffs | |
| 2012/0280517 | A1 | 11/2012 | Hair, III | |
| 2014/0290595 | A1 | 10/2014 | Owens | |
| 2017/0107899 | A1 | 4/2017 | Haring | |
| 2018/0195183 | A1* | 7/2018 | Domon | C25B 9/05 |
| 2018/0334751 | A1* | 11/2018 | Manabe | C25B 11/081 |
| 2018/0339759 | A1 | 11/2018 | Reeh | |
| 2020/0025062 | A1 | 1/2020 | Schuurman | |

* cited by examiner

Section A–A

BRINE ELECTROLYSIS SYSTEM FOR PRODUCING PRESSURIZED CHLORINE AND HYDROGEN GASES

CROSS-REFERENCE TO RELATED APPLICATIONS

This application is a continuation-in-part patent application of the commonly owned and allowed U.S. non-provisional patent application Ser. No. 16/557,214, titled "In-Water Refueling System for Unmanned Undersea Vehicles with Fuel Cell Propulsion," filed on Aug. 30, 2019 by inventor Benjamin Wilcox, the contents of which is hereby expressly incorporated herein by reference in its entirety and to which priority is claimed.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF USE

The present disclosure relates generally to electrolysis systems, and more particularly, to brine electrolysis systems used for the production of pressurized hydrogen and chlorine gases.

SUMMARY OF ILLUSTRATIVE EMBODIMENTS

To minimize the limitations in the related art and other limitations that will become apparent upon reading and understanding the present specification, the following discloses embodiments of a new and useful brine electrolysis system for producing pressurized chlorine and hydrogen gases.

One embodiment may be a brine electrolysis system, comprising: a tank having first and second interior spaces separated by a diaphragm; first and second pumps, each having an outlet sealably coupled to the tank and in fluid communication with the first and second interior spaces, respectively; a first open-bottom cylinder disposed within the tank and comprising: a first cylindrical body having a first cylindrical space in fluid communication with the first interior space of the tank; and a first float sensor adapted to raise and lower via buoyancy; a second open-bottom cylinder disposed within the tank and comprising: a second cylindrical body having a second cylindrical space in fluid communication with the second interior space of the tank; and a second float sensor adapted to raise and lower via buoyancy; first and second dispense lines disposed outside the tank and in fluid communication with the first and second cylindrical spaces, respectively; first and second submersible pumps disposed within the first and second interior spaces, respectively, the first submersible pump being configured to pump a first liquid reactant and the second submersible pump being configured to pump a second liquid reactant; and an electrolysis stack assembly traversing across the first and second interior spaces of the tank sealably connected to the diaphragm and comprising: one or more electrolysis stacks for creating first and second gases based on the first and second liquid reactants, respectively; first and second inlets in fluid communication with the first and second submersible pumps, respectively; a first outlet supply line traversing into the first cylindrical space through a first bottom opening of the first open-bottom cylinder for releasing the first gas into the first cylindrical space; and a second outlet supply line traversing into the second cylindrical space through a second bottom opening of the second open-bottom cylinder for releasing the second gas into the second cylindrical space. The first and second liquid reactants may be respectively a sodium chloride and a water; wherein the first and second gases may be a chlorine gas and a hydrogen gas, respectively. The electrolysis stack assembly may be a chlor-alkali electrolysis stack assembly containing layers of ion-selective membrane such that the first liquid reactant sodium chloride pumped by the first submersible pump may flow through the electrolysis stacks on one side of the membrane and the second reactant water pumped by the second submersible pump may flow through the electrolysis stacks on the other side of the membrane. The ion-selective membrane may be such material as to permit a counterion (Na+) to flow across the membrane when a voltage is applied to the electrolysis stack assembly to effect transfer from the first interior space in communication with one side of the membrane to the second interior space in communication with the other side of the membrane; and at substantially the same time produce chlorine gas entrained with liquid reactant sodium chloride on one side of the membrane and hydrogen gas entrained with liquid reactant water on the other side of the membrane; over time the sodium chloride liquid (brine) decreasing in concentration and the water converting to liquid sodium hydroxide (alkali) of increasing concentration. Exterior to the tank, the brine electrolysis system may further comprise first and second liquid storage tanks in fluid communication with first and second inlets of the first and second pumps, respectively. The brine electrolysis system may further comprise first and second motors operably coupled to the first and second pumps, respectively. The brine electrolysis system may further comprise a brine process controller and an ionic conductivity meter: wherein the ionic conductivity meter may be configured to measure a sodium chloride concentration within the first interior space of the tank; and wherein the brine process controller may be operably coupled to the first motor and the ionic conductivity meter and may regulate the sodium chloride concentration within the first interior space based on the sodium chloride concentration measurements. The brine electrolysis system may further comprise an alkali process controller and a pH meter; wherein the pH meter may be configured to measure a sodium hydroxide concentration within the second interior space of the tank; and wherein the alkali process controller may be operably coupled to the second motor and the pH meter and may regulate the sodium hydroxide concentration within the second interior space based on the sodium hydroxide concentration measurements.

Another embodiment may be a brine electrolysis system, comprising: a tank having first and second interior spaces separated by a diaphragm; a first pump having a first outlet sealably coupled to a first opening of the tank and in fluid communication with the first interior space; a second pump having a second outlet sealably coupled to a second opening of the tank and in fluid communication with the second interior space; a first open-bottom cylinder disposed within the first interior space and comprising: a first cylindrical body having a first cylindrical space in fluid communication with the first interior space of the tank; and a first float sensor adapted to raise and lower via buoyancy; a second open-bottom cylinder disposed within the second interior space and comprising: a second cylindrical body having a second cylindrical space in fluid communication with the second interior space of the tank; and a second float sensor adapted to raise and lower via buoyancy; a first dispense line disposed outside the tank and sealably coupled to the first open-bottom cylinder, such that the first dispense line is in fluid communication with the first cylindrical space; a second dispense line disposed outside the tank and sealably coupled to the second open-bottom cylinder, such that the second dispense line is in fluid communication with the second cylindrical space; a first submersible pump disposed within the first interior space of the tank for pumping a sodium chloride; a second submersible pump disposed within the second interior space of the tank for pumping a water; and a chlor-alkali electrolysis stack assembly disposed within the tank and traversing across the first and second interior spaces of the tank, the chlor-alkali electrolysis stack assembly comprising: one or more chlor-alkali electrolysis stacks for creating a chlorine gas and a hydrogen gas based on the sodium chloride and the water, respectively; first and second inlets in fluid communication with the first and second submersible pumps, respectively; a first outlet supply line traversing into the first cylindrical space through a first bottom opening of the first open-bottom cylinder for releasing the chlorine gas into the first cylindrical space, and a second outlet supply line traversing into the second cylindrical space through a second bottom opening of the second open-bottom cylinder for releasing the hydrogen gas into the second cylindrical space. The brine electrolysis system may further comprise first and second liquid storage tanks in fluid communication with first and second inlets of the first and second pumps, respectively; wherein the first and second liquid storage tanks may store the sodium chloride and the water, respectively. The brine electrolysis system may further comprise first and second motors operably coupled to the first and second pumps, respectively. The brine electrolysis system may further comprise a brine process controller and an ionic conductivity meter; wherein the ionic conductivity meter may be configured to measure a sodium chloride concentration within the first interior space of the tank; and wherein the brine process controller may comprise a first variable frequency drive (VFD) operably coupled to the first motor for regulating the sodium chloride concentration within the first interior space based on the sodium chloride concentration measurements. The brine electrolysis system may further comprise an alkali process controller and a pH meter; wherein the pH meter may be configured to measure a sodium hydroxide concentration within the second interior space of the tank; and wherein the alkali process controller may comprise a second VFD operably coupled to the second motor for regulating the sodium hydroxide concentration within the second interior space based on the sodium hydroxide concentration measurements. The diaphragm may be constructed of a flexible rubber material impermeable to transfer of a counterion (Na+) such that said transfer only occurs across the ion-selective membrane within the electrolysis stack assembly.

Another embodiment may be a brine electrolysis system, comprising: a tank having first and second interior spaces separated by a diaphragm; a first rotary screw pump having a first outlet that is sealably coupled to a first opening of the tank and in fluid communication with the first interior space; a second rotary screw pump having a second outlet that is sealably coupled to a second opening of the tank and in fluid communication with the second interior space; a first open-bottom cylinder disposed within the first interior space and comprising: a first cylindrical body having a first cylindrical space in fluid communication with the first interior space of the tank; and a first float sensor adapted to raise and lower via buoyancy; a second open-bottom cylinder disposed within the second interior space and comprising: a second cylindrical body having a second cylindrical space in fluid communication with the second interior space of the tank; and a second float sensor adapted to raise and lower via buoyancy; a first dispense line disposed outside the tank and sealably coupled to the first open-bottom cylinder, such that the first dispense line may be in fluid communication with the first cylindrical space; a second dispense line disposed outside the tank and sealably coupled to the second open-bottom cylinder, such that the second dispense line may be in fluid communication with the second cylindrical space; a first submersible pump disposed within the first interior space for pumping a sodium chloride through a chlor-alkali electrolysis stack assembly; a second submersible pump disposed within the second interior space for pumping a water through the chlor-alkali stack assembly; and the chlor-alkali electrolysis stack assembly disposed within the tank and traversing across the first and second interior spaces of the tank, the chlor-alkali electrolysis stack assembly, comprising: one or more chlor-alkali electrolysis stacks for creating a chlorine gas and a hydrogen gas based on the sodium chloride and the water, respectively; first and second inlets in fluid communication with the first and second submersible pumps, respectively; a first outlet supply line traversing into the first cylindrical space through a first bottom opening of the first open-bottom cylinder for releasing the chlorine gas into the first cylindrical space; and a second outlet supply line traversing into the second cylindrical space through a second bottom opening of the second open-bottom cylinder for releasing the hydrogen gas into the second cylindrical space. Exterior to the tank, the brine electrolysis system may further comprise first and second liquid storage tanks in fluid communication with first and second inlets of the first and second rotary screw pumps, respectively; and wherein the first and second liquid storage tanks may respectively store the sodium chloride and the water. The brine electrolysis system may further comprise first and second motors operably coupled to the first and second rotary screw pumps, respectively. The brine electrolysis system may further comprise a brine process controller and an ionic conductivity meter; wherein the ionic conductivity meter may be configured to measure a sodium chloride concentration within the first interior space of the tank; and wherein the brine process controller may comprise a first VFD operably coupled to the first motor for regulating the sodium chloride concentration within the first interior space based on the sodium chloride concentration measurements. The brine electrolysis system may further comprise an alkali process controller and a pH meter; wherein the pH meter may be configured to measure a sodium hydroxide concentration within the second interior space of the tank; and wherein the alkali process controller may comprise a second VFD operably coupled to the second motor for regulating the sodium hydroxide concentration within the second interior space based on the sodium hydroxide concentration measurements. The diaphragm may be constructed of a flexible rubber material impermeable to transfer of a counterion (Na+) such that the transfer only occurs across the ion-selective membrane within the electrolysis stack assembly.

It is an object to provide a brine electrolysis system, comprising a tank; a diaphragm dividing the inner space of the tank into two interior spaces; and at least two pumps for delivering liquid reactants into the two interior spaces of the tank. The two liquids are preferably sodium chloride (i.e., brine) and water, both of which are for use in a chlor-alkali electrolysis stack assembly and may be delivered from two liquid storage tanks. Upon filling the interior spaces of the tank with the two liquid reactants, the two pumps may further deliver and compress the liquid reactants into the tank, thereby elevating the pressure of the liquids within the two interior spaces of the tank. The brine electrolysis system may further comprise within the two interior spaces of the tank: a chlor-alkali electrolysis stack assembly that may draw electrical power for converting the liquid reactants within the tank into chlorine gas and hydrogen gas; two submersible pumps, each for delivering a liquid reactant through the chlor-alkali electrolysis stack assembly at a rate in accordance to the manufacture specification pertaining to the draw of electrical power and chlorine gas/hydrogen gas production rate; an ionic conductivity meter in communication with the first pump for regulating the flow of the liquid reactant into the first interior space of the tank, and the pressure of chlorine gas in equilibrium with the first liquid reactant, at substantially the same pressure, based on sodium chloride concentration; a pH sensor in communication with the second pump for regulating the flow of the liquid reactant into the second interior space of the tank, and the pressure of hydrogen gas in equilibrium with the second liquid reactant, at substantially the same pressure, based on sodium hydroxide concentration; a first open-bottom cylinder for storing and dispensing chlorine gas; a second open-bottom cylinder for storing and dispensing hydrogen gas; a first outlet supply line for transferring chlorine gas from the chlor-alkali electrolysis stack assembly to the first open-bottom cylinder; a second outlet supply line for transferring the hydrogen gas from the chlor-alkali electrolysis stack assembly to the second open-bottom cylinder; a first dispense line for transferring chlorine gas from the first open-bottom cylinder to the outside of the tank; and a second dispense line for transferring the hydrogen gas from the second open-bottom cylinder to the outside of the tank. The brine electrolysis assembly may also comprise a first dispense valve on the first dispense line for the purpose of regulating the transfer of chlorine gas from within the first open-bottom cylinder in the operation being reacted with ethane to produce polyvinyl chloride material fed to an additive printer. The brine electrolysis assembly may also comprise a second dispense valve on the second dispense line for the purpose of regulating the transfer of hydrogen gas from within a second open-bottom cylinder in the operation of cascade storage refilling a hydrogen gas storage tank; in the operation of refueling a UUV with fuel cell propulsion hydrogen gas storage tank; or for the purpose of venting the hydrogen gas from within the second open-bottom cylinder to the atmosphere.

Each open-bottom cylinder may also comprise a float sensor for determining the amount of fluid within the open-bottom cylinder based on density. Because gas is less dense than liquid, the gas generally accumulates above the liquid within the open-bottom cylinder. In particular, in one embodiment, the shape of the float may be a donut with small clearance between the sides of the float and the open-bottom cylinder and between the center opening of the float and the gas supply line. In this manner, the float may prevent the accumulated gas from transferring into the liquid within the open-bottom cylinder, according to Henry's Law of solubility of gases by making small the liquid surface area under the gas. In particular, the float sensors may move vertically up and down between two limit switches. Contact of the float sensor with the upper limit switch may indicate that the corresponding open-bottom cylinder may be depleted of stored gas, and thus, may signal closure of the respective dispense valve to prevent delivery of liquid from within the tank through the dispense lines. Contact of the float sensor with the upper limit switch may also activate the electrolysis stack assembly to produce more gas. Similarly, contact of the float sensor with the bottom limit switch may indicate that the corresponding open-bottom cylinder may be substantially filled with stored gas, and thus, may signal opening of the respective dispense valve to prevent gas from leaving the corresponding bottom opening of the open-bottom cylinder by removing the gas through the respective dispense line. Contact of the float sensor with the bottom limit switch may also inactivate the electrolysis stack assembly to halt the production of gases. In some embodiments, the float sensors may also include a linear transducer to determine the exact measurement of gas stored within the open-bottom cylinder. In a preferred embodiment, the exact volume of chlorine gas and hydrogen gas inside the open-bottom cylinders determined by the float sensors may be both established and maintained substantially unchanged via feedback to a controller. The controller may control the opening of the dispense valves in a manner such that the rate of gas evolution by the electrolysis stack assembly substantially equals to the rate of gas dispensing through the valves.

In various embodiments, there exists within each of the first interior space of the tank so filled with a sodium chloride liquid reactant compressed to elevated pressure, into every available space and in communication throughout, and comprising an electrolysis stack assembly, a first submersible pump, first outlet supply line for chlorine gas, first open-bottom cylinder into which chlorine gas accumulates when the electrolysis stack assembly draws electrical power, and first dispense line with a first dispense valve outside the tank for chlorine gas; so described a favorable condition for specification of these components material structural strength. Additionally, in various embodiments, there exists within the second interior spaces of the tank so filled with a water liquid reactant compressed to elevated pressure, into every available space and in communication throughout, and comprising the electrolysis stack assembly, a second submersible pump; second outlet supply line for hydrogen gas, second open-bottom cylinder into which hydrogen gas accumulates when the electrolysis stack assembly draws electrical power, and a second dispense line with a second dispense valve outside the tank for hydrogen gas, so described a favorable condition for specification of these components material structural strength: the electrolysis stack assembly may be structurally supported by the surrounding fluid such that its material strength need only withstand the small difference in pressure between inside and the interior spaces of the tank caused by the two secondary submersible pumps delivering liquid reactants through the tank and not the large difference in pressure between inside to the outside of the tank, a condition substantially independent of the interior spaces of the tank pressure; the fluid on the inside of the first outlet supply line and inside of the second outlet supply line may be in communion with at substantially the same fluid pressure as on the outside of the first outlet supply line and second outlet supply line and interior space of the tank, such that the respective gas line wall thickness need not support difference in fluid pressure, a condition substantially independent of the interior spaces of the tank pressure; and the fluid on the inside of the first open-bottom cylinder and inside of the second open-bottom cylinder may be in communion with at substantially the same fluid pressure as on the outside of the first open-bottom cylinder and second open-bottom cylinder and the respective interior space of the tank, such that the respective open-bottom cylinder wall thickness need not support difference in fluid pressure, a condition substantially independent of the interior space of the tank pressure; as the fluid pressure, chlorine gas pressure within the first outlet supply line, and hydrogen gas pressure within the second outlet supply line are all at substantially the same pressure, the chlorine gas pressure and hydrogen gas pressure within the chlorine gas and hydrogen gas channels inside the electrolysis stack assembly cell plate(s) may be at substantially the same pressure such that the cell plate need not withstand a difference in pressure from one side to the other, a condition substantially independent of the interior of the tank pressure. In general, the components structures within the interior spaces of the tank may be favorable to withstand compressive loads that may vary widely with fluid pressure and need not withstand tensile loads that substantially may not very widely with fluid pressure.

In various embodiments, there exists within the first interior space of the tank so filled with liquid compressed to elevated pressure, into every available space and in communication throughout, and comprising a chlor-alkali electrolysis stack assembly, a first submersible pump, first outlet supply line for chlorine gas, first open-bottom cylinder into which chlorine gas may accumulate when the chlor-alkali electrolysis stack assembly draws electrical power, and first dispense line with a first valve outside the tank for chlorine gas so described a favorable condition for specification and maintenance of gas pressure. Additionally, there exists within the second interior space of the tank so filled with liquid compressed to elevated pressure, into every available space and in communication throughout, and comprising the chlor-alkali electrolysis stack assembly, a second submersible pump, second outlet supply line for hydrogen gas, second open-bottom cylinder into which hydrogen gas accumulates when the chlor-alkali electrolysis stack assembly draws electrical power, and second dispense line with a second valve outside the tank for hydrogen gas, so described a favorable condition for specification and maintenance of gas pressure. As noted, since the fluid pressure, chlorine gas pressure, and hydrogen gas pressure are substantially the same (hereinafter designated as "pressure-of-use" of the gas), the pressure-of-use may be selectively determined from the amount of liquid compressed into the interior spaces of the tank by the two pumps. Preferably, the two pumps are screw-pumps such that the pressure-of-use of the gas may be elevated by compressing/adding fluid into the interior spaces of the tank by turning its screw in the "forward" rotational direction, and the pressure-of-use of the gas may be lowered by decompressing/removing liquid from the interior space of the tank by turning its screw in the "back" or "reverse" rotational direction. Upon selection of the pressure-of-use of the gas at some elevated pressure, activating the chlor-alkali electrolysis stack assembly and the two submersible pumps may convert the liquid reactants into chlorine gas and hydrogen gas, each accumulating and stored above the liquid within its respective open-bottom cylinder, the process tending to elevate the pressure-of-use of the gas at the same time; the pressure-of-use of the gas may be maintained with substantially small change by operating the respective screw pump in reverse to remove liquid from each interior spaces of the tank. Upon inactivating the chlor-alkali electrolysis stack assembly and first submersible pump and opening the first valve outside the tank on the first outlet supply line, the chlorine gas stored is preferably transferred from the first open-bottom cylinder by diffusion; the pressure-of-use of the gas may be maintained with substantially small change, at substantially constant pressure, by operating the respective screw pump in forward to add the first liquid reactant into the first interior space of the tank as the chlorine gas leaves. Upon inactivating the chlor-alkali electrolysis stack assembly and second submersible pump and opening the second valve outside the tank on the second outlet supply line, the hydrogen gas stored is preferably transferred from the second open-bottom cylinder by diffusion; the pressure-of-use of the gas may be maintained with substantially small change, at substantially constant pressure, by operating the respective screw pump in forward to add liquid into the second interior space of the tank as the hydrogen gas leaves. Upon activating the chlor-alkali electrolysis stack assembly and first submersible pump and opening the first dispense valve outside the tank on the first dispense line, the chlorine gas stored is preferably transferred from the first open-bottom cylinder by diffusion; the pressure-of-use of the gas may by maintained with substantially small change, at substantially constant pressure, when the chlor-alkali electrolysis stack chlorine gas production rate is substantially same as the hydrogen gas transfer rate by diffusion without operating the respective screw pump in forward or reverse. During activation of the chlor-alkali electrolysis stack assembly and second submersible pump and opening the second dispense valve outside the tank on the second dispense line, the hydrogen gas stored is preferably transferred from the second open-bottom cylinder by diffusion; the pressure-of-use of the gas may by maintained with substantially small change, at substantially constant pressure, when the chlor-alkali electrolysis stack hydrogen gas production rate is substantially same as the hydrogen gas transfer rate by diffusion without operating the respective screw pump in forward or reverse. During activation of the chlor-alkali electrolysis stack assembly and the first and second submersible pumps and opening the first dispense valve outside the tank on the first dispense line and the second dispense valve outside the tank on the second dispense line, the chlorine gas stored and hydrogen gas stored are preferably transferred from the first and second open-bottom cylinder, respectively, by diffusion; the pressure-of-use of the gas may by maintained with substantially small change, at substantially constant pressure, when the chlor-alkali electrolysis stack chlorine gas production rate is substantially same as the chlorine gas transfer rate by diffusion and the hydrogen gas production rate is substantially the same as the hydrogen gas transfer rate by diffusion, without operating both screw pumps in forward or reverse. In general, the pressure-of-use of the gas within the interior spaces of the tank may be favorably specified, maintained, and varied while dispensing by operating the two pumps in forward and reverse, or by increasing and decreasing the chlor-alkali electrolysis stack assembly chlorine gas and hydrogen gas production rate, or by a combination of the two. In the operation so described, some embodiments of the diaphragm may be constructed of a flexible rubber material so as to make equal the pressure in the first interior space and second interior space. When the case should arise that the first interior space is over-filled with the first reactant, the diaphragm may stretch and contact a second deflection switch in the second interior space that will temporarily shut-off the first pump motor. Similarly, when the case should arise that the second interior space is over-filled with the second reactant, the diaphragm may stretch and contact a first deflection switch in the first interior space that will temporarily shut-off the second pump motor. Thus the first and second reactant volumes and pressures (equal) may be substantially maintained during operation of the system.

Various embodiments of the brine electrolysis system disclosed herein may be used as a land-based refueling system for fuel cell vehicles and stationary fuel cells. Embodiments of the brine electrolysis system may also be used to refuel hydrogen gas fuel storage tanks of fuel cell vehicles on land. Other embodiments of the brine electrolysis system may refill chlorine gas storage tanks for producing polyvinyl chloride material fed to an additive printer.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are illustrative embodiments. They do not illustrate all embodiments. They do not set forth all embodiments. Other embodiments may be used in addition or instead. Details, which may be apparent or unnecessary, may be omitted to save space or for more effective illustration. Some embodiments may be practiced with additional components or steps and/or without all of the components or steps, which are illustrated. When the same numeral appears in different drawings, it is intended to refer to the same or like components or steps.

Figure 1:
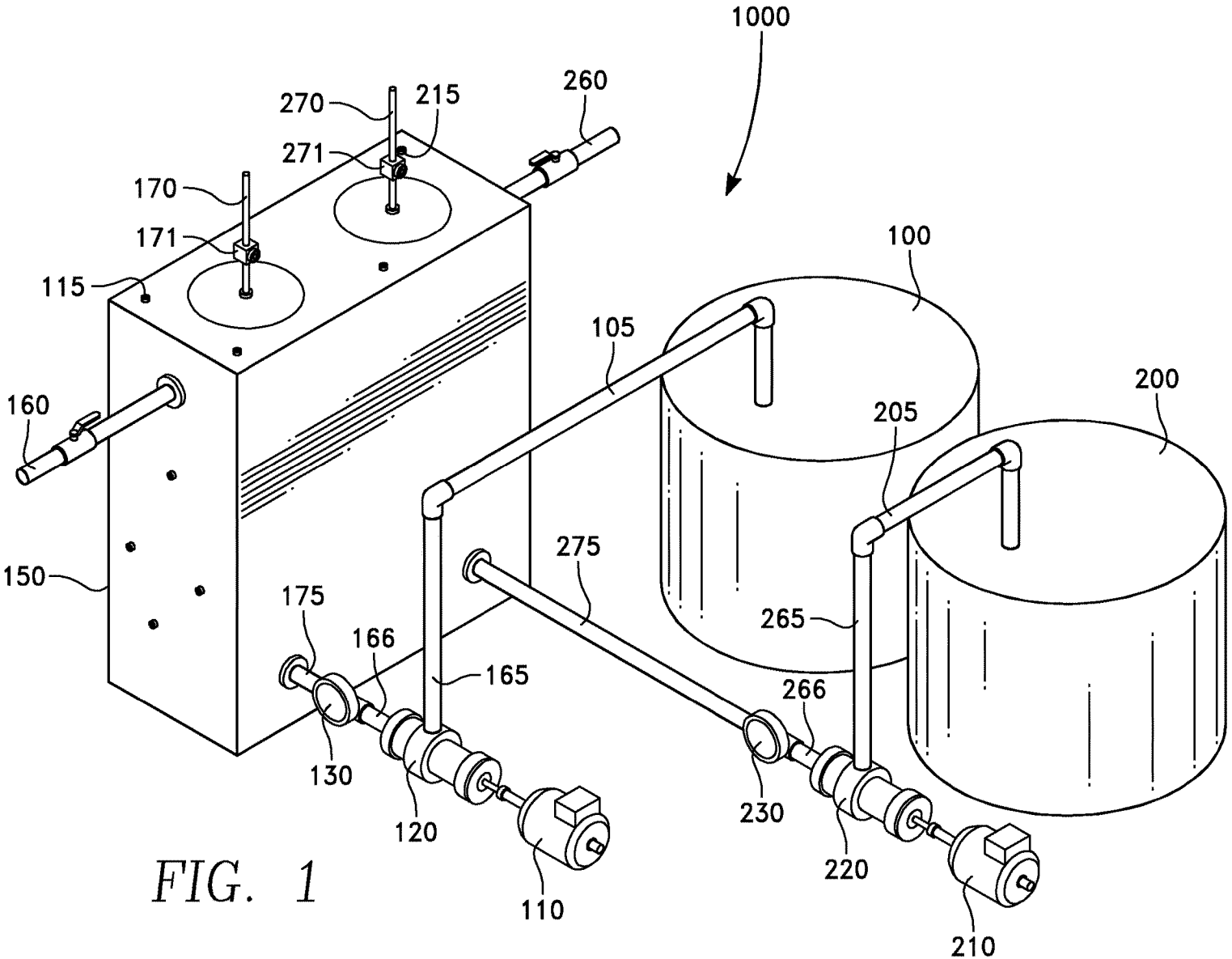
FIG. 1 illustrates a perspective view of one embodiment of a brine electrolysis system for producing pressurized chlorine and hydrogen gases, in accordance with the present disclosure.

It is to be understood that the foregoing general description and the following detailed description are exemplary and explanatory only and are not to be viewed as being restrictive of the embodiments, as claimed. Further advantages of these embodiments will be apparent after a review of the following detailed description of the disclosed embodiments, which are illustrated schematically in the accompanying drawings and in the appended claims.

DETAILED DESCRIPTION OF ILLUSTRATIVE EMBODIMENTS

In the following detailed description, numerous specific details are set forth in order to provide a thorough understanding of various aspects of one or more embodiments of the brine electrolysis system for producing pressurized chlorine and hydrogen gases. However, these embodiments may be practiced without some or all of these specific details. In other instances, well-known methods, procedures, and/or components have not been described in detail so as not to unnecessarily obscure the aspects of these embodiments.

Before the embodiments are disclosed and described, it is to be understood that these embodiments are not limited to the particular structures, process steps, or materials disclosed herein, but is extended to equivalents thereof as would be recognized by those ordinarily skilled in the relevant arts. It should also be understood that the terminology used herein is used for the purpose of describing particular embodiments only and is not intended to be limiting.

Reference throughout this specification to "one embodiment," "an embodiment," or "another embodiment" may refer to a particular feature, structure, or characteristic described in connection with the embodiments of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in various embodiments. In the following description, numerous specific details are provided, such as examples of materials, fasteners, sizes, lengths, widths, shapes, etc . . . , to provide a thorough understanding of the embodiments. One skilled in the relevant art will recognize, however, that the scope of the disclosed embodiments can be practiced without one or more of the specific details, or with other methods, components, materials, etc. . . . . In other instances, well-known structures, materials, or operations are generally not shown or described in detail to avoid obscuring aspects of the disclosure.

DEFINITIONS

In the following description, certain terminology is used to describe certain features of the embodiments of the brine electrolysis system in accordance with the present disclosure. For example, as used herein, unless otherwise specified, the term "substantially" refers to the complete, or nearly complete, extent or degree of an action, characteristic, property, state, structure, item, or result. As an arbitrary example, an object that is "substantially" surrounded would mean that the object is either completely surrounded or nearly completely surrounded. The exact allowable degree of deviation from absolute completeness may in some cases depend on the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "liquid reactant" generally refers to a liquid substance capable of entering and being altered in the course of a chemical reaction, including without limitation, a first liquid reactant and a second liquid reactant. The term "first liquid reactant" generally refers to sodium chloride or brine, including varying concentrations of sodium chloride, but may also include varying concentration of potassium chloride, or mixture of sodium hydroxide and potassium hydroxide. The term "second liquid reactant" generally refers to water, including water having varying concentrations of sodium hydroxide, but may also include varying concentrations of potassium hydroxide, or mixture of sodium hydroxide and potassium hydroxide thereof. The substitution of sodium and potassium in brine being well known.

As used herein, the term "approximately" may refer to a range of values of 100% of a specific value. For example, the expression "approximately 150 inches" may comprise the values of 150 inches 10%, i.e. the values from 135 inches to 165 inches.

As used herein, the term "about" is used to provide flexibility to a numerical range endpoint by providing that a given value may be "a little above" or "a little below" the endpoint. In some cases, the term "about" is to include a range of not more than about two inches of deviation.

As used herein in this disclosure, the singular forms "a" and "the" may include plural referents, unless the context clearly dictates otherwise. Thus, for example, reference to an "opening" can include reference to one or more of such openings.

The present disclosure relates generally to electrolysis systems, and more particularly, to brine electrolysis systems used for the production of pressurized hydrogen and chlorine gases. The brine electrolysis system disclosed herein preferably produces and dispenses hydrogen and chlorine gases at elevated pressure in equilibrium. In particular, liquid reactant streams of concentrated sodium chloride (e.g., brine or aqueous solution of NaCl) and water are preferably circulated through the brine electrolysis system, which generates chlorine gas and hydrogen gas at elevated pressure. Production of hydrogen and chlorine gases at elevated pressure avoids the use of gas compression and simplifies drying of gases downstream as well as pressure management in additional processing. The hydrogen gas may be supplied as fuel for UUVs utilizing fuel cell propulsion. The chlorine gas may be used to react with ethane to produce polyvinyl chloride material fed to a 3-D or additive manufacturing printer.

In its basic configuration, the brine electrolysis system may comprise: two liquid storage tanks for storing two liquid reactants; a tank having two interior spaces separated by a diaphragm for receiving the two liquid reactants; two pumps for regulating the flow of the two liquid reactants from the liquid storage tanks to the two interior spaces of the tank; an electrolysis stack assembly for converting the two liquid reactants into two gases; two submersible pumps for pumping each liquid reactant into the electrolysis stack assembly; and two open-bottom cylinders for storing and dispensing two gases. Each open-bottom cylinder may comprise a float sensor for determining the amount of fluid entering its cylindrical space of each open-bottom cylinder. The system may further comprise one or more controllers for regulating reactant concentrations based upon ionic conductivity measurements in the two interior spaces. Dispense lines and dispense valves may be utilized to release the gases from the tank.

FIG. 1 illustrates a perspective view of one embodiment of a brine electrolysis system 1000 for producing pressurized chlorine and hydrogen gases, in accordance with the present disclosure. As shown in FIG. 1, one embodiment of the brine electrolysis system 1000 may comprise: first and second pumps 120, 220, first and second liquid storage tanks 100, 200, first and second lines 105, 205, first and second motors 110, 210, first and second pressure gauges 130, 230, first and second outflow lines 160, 260, first and second dispense lines 170, 270, first and second dispense valves 171, 271, ionic conductivity meter 115, pH meter 215, and tank 150.

The tank 150 may be any fluid tight structure having at least two interior spaces 106, 107 (shown in FIGS. 2 and 4) particularly suited for holding and storing a fluid, liquid, gas, or other substance. A diaphragm 320 (shown in FIGS. 2 and 4) preferably separates the two interior spaces 106, 107 and may be constructed of a flexible material (e.g., rubber) in order to make the pressure within the two interior spaces 106, 107 equal.

The tank 150 may also be a hyperbaric tank adapted to withstand high fluid pressure and may comprise one or more openings for coupling or fitting various components. For example, as shown in FIG. 1, the brine electrolysis system 1000 may comprise first and second pressure gauges 130, 230 and first and second dispense lines 170, 270, all of which may couple to openings of the tank 150. In particular, the outlets 175, 275 of the first and second pressure gauges 130, 230 may be fitted and sealably attached to openings of the tank 150, whereas the first and second dispense lines 170, 270 may be fitted and sealably attached to top openings of the tank 150.

In various embodiments, the tank 150 may be constructed of any metal or high durable material such as steel and aluminum but may also be constructed from other suitable materials such as fiberglass or plastic. Alternatively, the tank 150 may be constructed of a composite structure such as carbon fiber wrapped aluminum and polymer liners. In various embodiments, the tank 150 may also comprise a liner to serve as a gas permeation barrier in order to prevent leaking of a fluid, liquid, gas, or other substance. Embodiments of the liners may be constructed of carbon fiber wrapped aluminum, for example.

FIG. 1 also shows that the brine electrolysis system 1000 may also comprise first and second liquid storage tanks 100, 200, which may be any fluid storage device used as a source for supplying liquid reactants to the first and second pumps 120, 220 and the tank 150. In a preferred embodiment, the first and second liquid storage tanks 100, 200 may be liquid storage chambers capable of storing liquids, preferably a first liquid reactant 140 (e.g., sodium chloride) and a second liquid reactant 240 (e.g., water), both shown in FIGS. 4 and 5. While FIG. 1 shows the brine electrolysis system 1000 having first and second liquid storage tanks 100, 200, other embodiments of the brine electrolysis system 1000 may function without liquid storage tanks 100, 200 and thus may obtain liquid from other sources, as for example from multiple tanks or pressure vessels.

FIG. 1 also shows that the brine electrolysis system 1000 may further comprise first and second pumps 120, 220, which may be any device that moves or transfers fluids into the interior spaces 106, 107 of the tank 150 via mechanical action. The first pump 120 may comprise an inlet 165 and an outlet 166, wherein the outlet 166 may be in fluid communication with the interior space 106 of the tank 150 and the inlet 165 may be in fluid communication with the first liquid storage tank 100 via line 105. Similarly, the second pump 220 may comprise an inlet 265 and an outlet 266, wherein the outlet 266 may be in fluid communication with the interior space 107 of the tank 150 and the inlet 265 may be in fluid communication with the second liquid storage tank 200 via line 205. In this manner, the first liquid reactant 140 (e.g., sodium chloride, brine) stored in the first liquid storage tank 100 may flow into the first interior space 106 of the tank 150 via the first pump 120 at elevated pressure, and the second liquid reactant 240 (e.g., water) stored in the second liquid storage tank 200 may flow into the second interior space 107 of the tank 150 via the second pump 220 at elevated pressure.

In various embodiments, the first and second pumps 120,220 may be a positive displacement pump such as a rotary screw pump, such as the one shown in FIG. 1. The rotary screw pump may also employ one or several screws to move fluids along the axis of the screw(s). Embodiments of the first and second pumps 120, 220 are preferably a multi-phase or twin-screw pump suitable for pumping liquid water, as for example those manufactured by ITT Bornemann GmbH.

Importantly, as mentioned above, the brine electrolysis system 1000 may also comprise an electrolysis stack assembly 310 (shown in FIGS. 2 and 4), which is preferably a chlor-alkali electrolysis stack assembly, for dissociating the liquid reactants sodium chloride and water into chlorine and hydrogen gases while in addition producing sodium hydroxide. Here, the electrolysis stack assembly 310 may include layers of ion-selective membrane. For example, in an exemplary embodiment, the ion-selective membrane may allow the counterion ($Na^+$) to freely flow across, but preferably prevents hydroxide ($OH^-$) and chloride ($Cl^-$) from diffusing across. Examples of such ion-selective membranes may include, without limitation, Nafion®, Flemion®, or Aciplex®, each of which may be used to prevent reaction between the chlorine and hydroxide ions. The resulting gaseous components may then be outputted through various inner components of the tank 150 and ultimately the dispense lines 170, 270. For example, in an exemplary embodiment, the electrolysis stack assembly 310 may be a chlor-alkali electrolysis stack assembly designed to dissociate brine and water in order to produce chlorine gas 199 and hydrogen gas 299 at substantially the same time (shown in FIG. 5).

Furthermore, FIG. 1 shows that the brine electrolysis system 1000 may further comprise an ionic conductivity meter 115 and pH meter 215. The ionic conductivity meter 115 is preferably in fluid contact with the first interior space 106 of the tank 150 and may be configured to measure the ionic conductivity and thus sodium chloride concentration of the first liquid reactant 140 within the tank 150. Additionally, the pH meter 215 is preferably in fluid contact with the second interior space 107 of the tank 150 and may be configured to measure the ionic conductivity and thus sodium hydroxide concentration of the second liquid reactant 240 within the tank 150.

Finally, FIG. 1 shows that the brine electrolysis system 1000 may further comprise first and second outflow lines 160, 260. The first outflow line 160 may permit release of the first liquid reactant 140 having less concentrations of sodium chloride from the first interior space 106 of the tank 150. The second outflow line 260 may permit release of the second liquid reactant 240 having increased concentrations of sodium hydroxide from the second interior space 107 of the tank 150. In this manner, the brine electrolysis system 1000 may be capable of selectively releasing sodium chloride and sodium hydroxide based upon the ionic conductivity measurement of those liquid reactants—that is, brine when its associated sodium chloride solution concentration is depleted to its lower process control limit and alkali when its associated sodium hydroxide concentration is increased to its upper process control limit.

Other embodiments of the brine electrolysis system 1000 may further comprise additional components such as sensors for managing the process flow of fluids, liquids, and gases. For example, additional sensors of the brine electrolysis system 1000 may include gas component fraction sensors to monitor the gas fraction for revealing combustible mixtures. Other additional components may also include pressure relief devices for preventing or relieving pressure.

Figure 2:
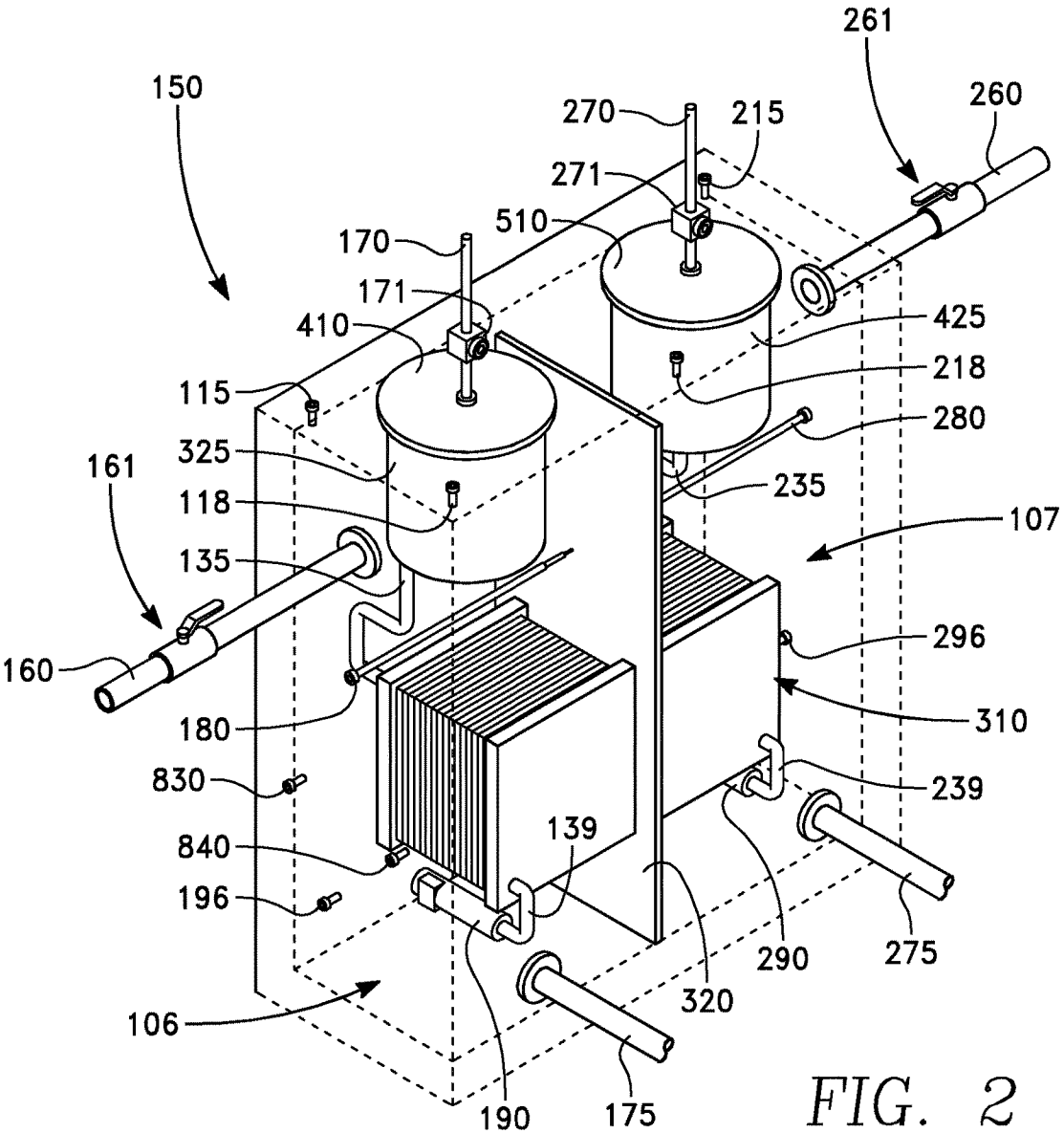
FIG. 2 illustrates a perspective view of a portion of one embodiment of the brine electrolysis system and shows the inner components of the tank.

FIG. 2 illustrates a perspective view of a portion of one embodiment of the brine electrolysis system 1000 and shows the inner components of the tank 150. A first liquid reactant 140 (i.e., sodium chloride) may be stored within the first interior space 106 of the tank 150, and a second liquid reactant 240 (i.e., water) may be stored within the second interior space 107 of the tank 150. Sodium chloride and water are preferably delivered to the tank 150 from the first and second liquid storage tanks 100, 200, respectively. As shown in FIG. 2, an embodiment of the brine electrolysis system 1000 may comprise: first and second outflow lines 160, 260 with their respective outflow valves 161, 261 for the replacement of varying concentrations of sodium chloride and water/sodium hydroxide, first and second dispense lines 170, 270, ionic conductivity meter 115, pH meter 215, and tank 150. Additionally, an embodiment of the tank 150 may comprise open-bottom cylinders 410, 510, an electrolysis stack assembly 310, and first and second submersible pumps 190, 290.

Specifically, FIG. 2 depicts the tank 150 having two interior spaces (i.e., first interior space 106, second interior space 107), both of which may be defined by a wall and diaphragm 320. The diaphragm 320 is preferably sealable fitted to the interior wall of the pressure vessel 150 and to the electrolysis stack assembly 310, thus dividing internal volume of the tank 150 into two spaces. The diaphragm 320 may also permit substantially equal pressure of the first liquid reactant 140 (e.g., sodium chloride) and the second liquid reactant 240 (e.g, water, highly concentrated water/sodium hydroxide combination) within the tank 150 (note: as the brine electrolysis system 1000 operates, the water may be converted to sodium hydroxide having an increasing concentration). The size of the first and second interior spaces 106, 107 may also be affected by the placement of the inner components of the tank 150. In particular, the outlets 175, 275 of the first and second pumps 120, 220 may be sealably coupled to bottom openings of the tank 150 and may allow fluid to enter or leave the tank 150 via the first and second pumps 120, 220. Additionally, the open-bottom cylinders 410, 510 may be sealably coupled at or near the ceiling of the tank 150 and may have a cylindrical body 425, 525 substantially disposed within the first and second interior spaces 106, 107 of the tank 150. The interior space of the open-bottom cylinders 410, 510 may also be in fluid communication with the first and second dispense lines 170, 270 with respective to dispense valves 171, 271 located above and outside the tank 150.

The electrolysis stack assembly 310 is preferably a chlor-alkali electrolysis stack assembly configured to dissociate brine and water in order to produce chlorine gas 199 and sodium hydroxide. The electrolysis stack assembly 310 is also preferably configured to dissociate water in order to produce hydrogen gas 299. The electrolysis stack assembly 310 is generally sealably fitted with the diaphragm 320 and may traverse across the first interior space 106 and second interior space 107 through the diaphragm 320. Further, the electrolysis stack assembly 310 is preferably disposed between the open-bottom cylinders 410, 510 and the first and second submersible pumps 190, 290. In this manner, the electrolysis stack assembly 310 may be in fluid communication with the first interior space 106 and second interior space 107 of the tank 150 to perform electrolysis on sodium chloride and water stored in the tank 150.

In order to supply chlorine gas 199 and hydrogen gas 299, additional supply lines (not shown) may be coupled to the first and second dispense lines 170, 270 outside the tank 150 and may be controlled by the dispense valves 171, 271. The first and second submersible pumps 190, 290 preferably circulate the first liquid reactant 140 (e.g., sodium chloride, brine) and second liquid reactant 240 (water, water/sodium hydroxide combination) through the electrolysis stack assembly 310. Specifically, during operation of the brine electrolysis system 1000, the first liquid reactant 140 may be pumped via the first pump 120 from the first liquid storage tank 100, which may store a higher concentration of sodium chloride (i.e., a saturated solution), into the tank 150 at an elevated pressure. Here, on one side of the diaphragm 320, the first submersible pump 190 may transfer the sodium chloride) through the electrolysis stack assembly 310 to produce chlorine gas 199. At the same time, sodium ion Na(+) may transfer across the ion-selective membrane of the diaphragm 320, and as a result, the concentration of the remaining sodium chloride liquid (now preferably entrained with chlorine gas 199) may be lowered upon exiting the electrolysis stack assembly 310. During this time, on the other side of the diaphragm 320, the second liquid reactant 240 (i.e., water) may be pumped via the second pump 220 from the second liquid storage tank 200, which may store a neutral concentration (i.e., pH=7) into the tank 150 at an elevated pressure. The second submersible pump 290 may transfer the water through the electrolysis stack assembly 310 to produce hydrogen gas 299. At the same time, sodium ion Na(+), which transferred across the ion-selective membrane of the diaphragm 320, may increase the concentration of sodium hydroxide within the water (i.e., alkali now preferably entrained with hydrogen gas 299) to create a water/sodium hydroxide liquid combination. Importantly, the sodium chloride concentration of the first liquid reactant 140 may be lowered, and the sodium hydroxide concentration within the water of the second liquid reactant 240 may be raised during circulation of the first and second submersible pumps 190, 290 through the electrolysis stack assembly 310. In this manner, the volume of the liquid reactants (i.e., sodium chloride, water) should be replaced via transfer through the first and second outflow lines 160, 260 and first and second liquid storage tanks 100, 200.

Importantly, FIG. 2 also shows that the brine electrolysis system 1000 may further comprise: a brine temperature gauge 118, an alkali temperature gauge 218, brine submersible pump flow rate gauge 1%, alkali submersible pump flow rate gauge 296, power supply positive lead flange 830, and power supply negative lead flange 840. The brine temperature gauge 118 and alkali temperature gauge 218 may both be configured to measure the temperatures within the first interior space 106 and second interior space 107, respectively, and may provide feedback to the controller 900 (shown in FIG. 6) via temperature lines 119, 219 (shown in FIG. 6) to regulate temperatures within the first interior space 106 and second interior space 107 of the tank 150. In this manner, the temperature of the first interior space 106 and second interior space 107 may be maintained according to the manufacturer's specification of the electrolysis stack assembly 310 when converting the first liquid reactant 140 (i.e., sodium chloride) and the second liquid reactant 240 (i.e., water, water with sodium hydroxide (of lower concentration)) into chlorine gas 199, hydrogen gas 299, and sodium hydroxide (of higher concentration).

The brine submersible pump flow rate gauge 196 and alkali submersible pump flow rate gauge 296 are preferably instruments configured to measure the volumetric flow rates of the first and second submersible pumps 190, 290 within the first interior space 106 and second interior space 107 of the tank 150. The brine submersible pump flow rate gauge 196 and alkali submersible pump flow rate gauge 296 may also provide feedback to the controller 900 via flow rate lines 197, 297 (shown in FIG. 7). Based on these volumetric flow rate measurements, the controller 900 may adjust the pumping action of the submersible pumps 190, 290 according to the manufacturer's specification of the electrolysis stack assembly 310 when converting the liquid reactants into chlorine gas 199, hydrogen gas 299, and sodium hydroxide (of higher concentration).

The power supply positive lead flange 830 and power supply negative lead flange 840 are preferably in electrical communication with the end plates of the electrolysis stack assembly 310 and establish an electrical potential difference between the end plates of the electrolysis stack assembly 310 for electrolysis operation. The power supply positive lead flange 830 and power supply negative lead flange 840 are preferably in electrical communication with the power supply 820 via power supply lines 831, 841 (shown in FIG. 7). Feedback and control through temperature gauges 118, 218 may activate or inactivate the power supply 820 in order to maintain the temperature range within the manufacturer's specification for the electrolysis stack assembly 310.

Finally, FIG. 2 shows that the tank 150 may further comprise first and second deflection switches 180, 280. The first deflection switch 180 may provide feedback control to the second motor 210 and second pump 220 in order to maintain volume of the second liquid reactant 240 between design under fill and over fill amounts within the tank 150. Similarly, the second deflection switch 280 may provide feedback control to the first motor 110 and first pump 120 in order to maintain volume of the first liquid reactant 140 between design under-fill and over-fill amounts within the tank 150. In particular, the first deflection switch 180 may activate when the second liquid reactant 240 stored within the second interior space 107 expands the diaphragm 320, thereby causing the diaphragm 320 to contact the first deflection switch tip 192. Similarly, the second deflection switch 280 may activate when the first liquid reactant 140 stored within the first interior space 106 expands the diaphragm 320, thereby causing the diaphragm 320 to contact the second deflection switch tip 292.

In operation, the first submersible pump 190 circulates first liquid reactant 140 (i.e., sodium chloride) through the electrolysis stack assembly 310 within the tank 150. Additionally, the second submersible pump 290 circulates the second liquid reactant 240 (i.e., water) through the electrolysis stack assembly 310. In various embodiments, application of a DC potential difference between the end plates of the electrolysis stack assembly 310 via the power supply positive lead flange 830 and power supply negative lead flange 840 may then convert the sodium chloride and water via electrolysis to generate sodium chloride with entrained chlorine gas 199 and a water/sodium hydroxide combination with entrained hydrogen gas 299. The sodium chloride with entrained chlorine gas 199 and water with entrained hydrogen gas 299 may be fed through outlet supply lines 135, 235 and into the first and second cylinder spaces 420, 520 (shown in FIG. 4) of the open-bottom cylinders 410, 510. There, the chlorine gas 199 and first liquid reactant 140 may separate by difference in density with the chlorine gas 199 on top. Additionally, the hydrogen gas 299 and second liquid reactant 240 may separate by difference in density with the hydrogen gas 299 on top. The chlorine gas 199 and hydrogen gas 299 may then later be release through the first and second dispense lines 170, 270 through control of the dispense valves 171, 271.

Figure 3:
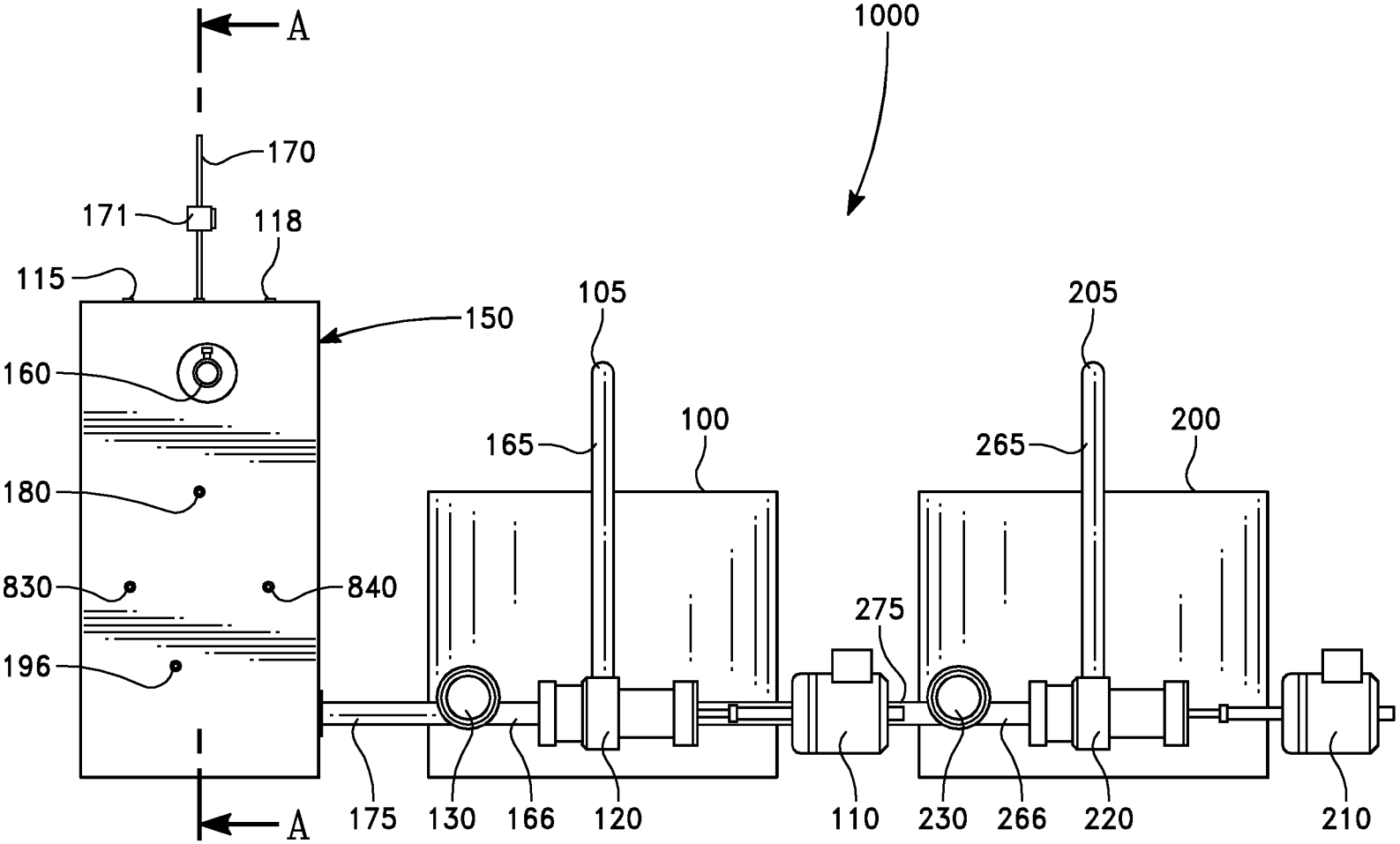
FIG. 3 illustrates a side elevation view of one embodiment of the brine electrolysis system.

FIG. 3 illustrates a side elevation view of one embodiment of the brine electrolysis system. As shown in FIG. 3, one embodiment of the brine electrolysis system 1000 may comprise: first and second pumps 120, 220, first and second liquid storage tanks 100, 200, first and second lines 105, 205, first and second motors 110, 210, first and second pressure gauges 130, 230, and tank 150. Tank 150 may further comprise an outflow line 160, dispense line 170 with dispense line valve 171, deflection switch 180, ionic conductivity meter 115, brine submersible pump flow rate gauge 196, DC power supply positive lead flange 830, and DC power supply negative lead flange 840.

Figure 4:
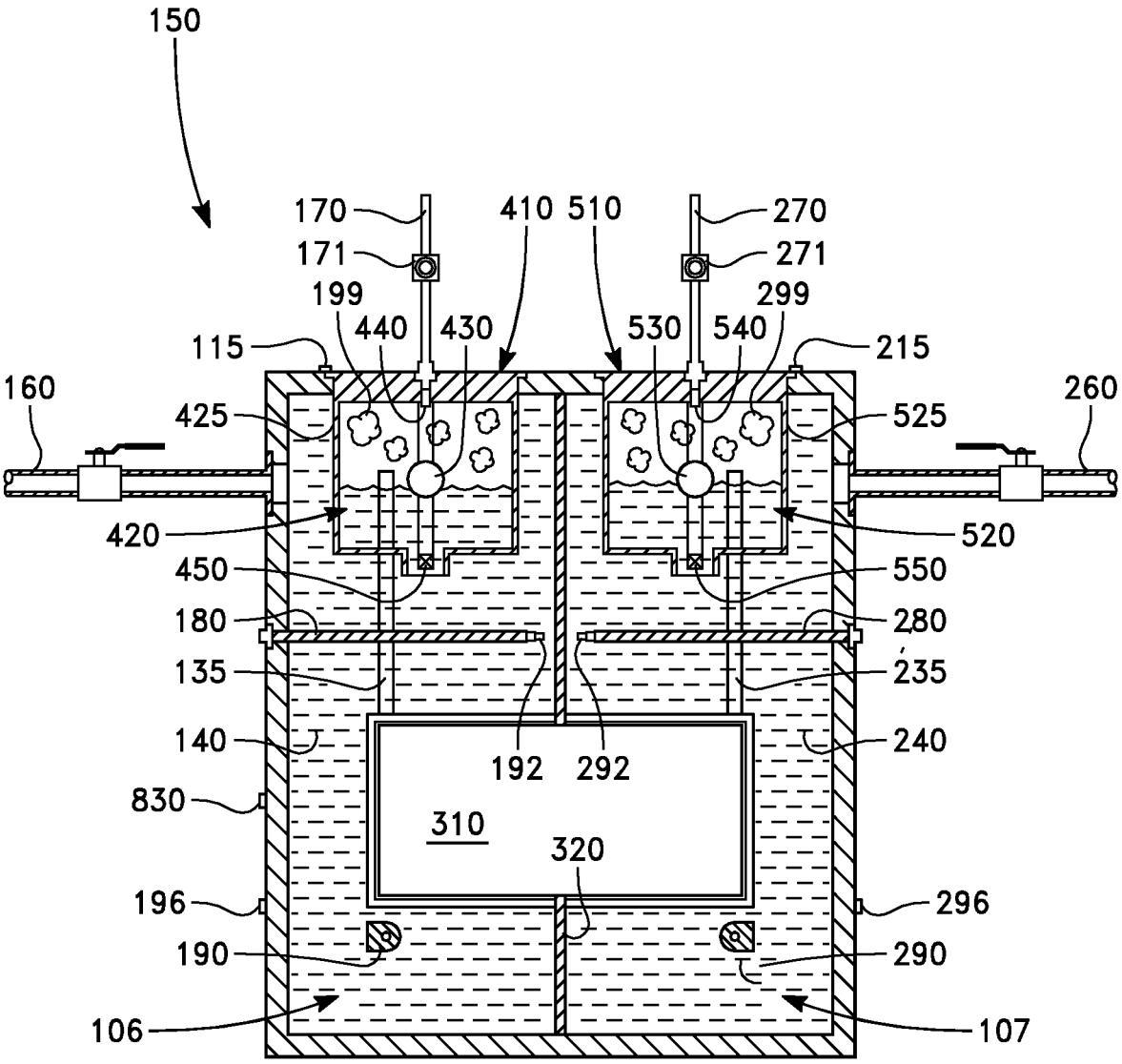
FIG. 4 illustrates a front cross section view of one embodiment the tank and shows the inner components of the tank in more detail, including the inner components of the open-bottom cylinders.

FIG. 4 illustrates a front cross section view of one embodiment the tank 150 and shows the inner components of the tank 150 in more detail, including the inner components of the open-bottom cylinders 410, 510. Specifically, FIG. 4 shows that each of the open-bottom cylinders 410, 510 may comprise a cylindrical body 425, 525 and float sensor 430, 530. The float sensors 430, 530 may be disposed within the cylinder space 420, 520 and may be configured to move in a vertical manner indicative of the level of the liquid reactants within the open-bottomed cylinders 410, 510. Importantly, the float sensors 430, 530 may be used to determine the fluid level stored within the cylinder space 420, 520 based on the differing densities between the fluid and gas. In particular, the float sensors 430, 530 may move vertically up and down between two limit switches (i.e., upper limit switches 440, 540, bottom limit switches 450, 550). Contact of the float sensors 430, 530 with the upper limit switches 440, 540 may indicate that the corresponding open-bottom cylinders 410, 510 are depleted of stored gas and filled with liquid. This in turn may cause the upper limit switches 440, 540 to send a signal, which may (1) close a respective dispense valve 171, 271 of the first and second dispense lines 170, 270 to prevent delivery of liquid from within the open-bottom cylinders 410, 510 through the first and second dispense lines 170, 270 and/or (2) activate the electrolysis stack assembly 310 to produce more gases. Similarly, contact of the float sensors 430, 530 with the bottom limit switches 450, 550 may indicate that the corresponding open-bottom cylinder 410, 510 may be filled with stored gas. This in turn may cause the bottom limit switches 450, 550 to send a signal, which may (1) open a respective dispense valves 171, 271 of the first and second dispense lines 170, 270 to prevent gas from leaving the bottom of the corresponding open-bottom cylinders 410, 510 by releasing gas through the first and second dispense lines 170, 270 and/or (2) inactivating the electrolysis stack assembly 310 to halt production of the gases. In various embodiments, the float sensors 430, 530 may also include a linear transducer to determine the exact measurement of gas stored within the open-bottom cylinders 410, 510. In a preferred embodiment, as previously described, the exact volume of chlorine and hydrogen gases within the open-bottom cylinders 410 determined by the float sensors 430, 530 may be both established and maintained substantially unchanged by providing feedback to the controller 900 and using that feedback to determine and partially control the opening of the dispense valves 171, 271 of the first and second dispense lines 170, 270. In this manner, the rate of gas evolution by the electrolysis stack assembly 310 preferably equals to the rate of gas dispensing through the first and second dispense lines 170, 270. The entirety of the electrolysis stack assembly 310 may be electrically insulated from the surrounding fluid by design or through application of a coating (i.e. urethane or rubber) in order to avoid self-discharge between cells.

By way of example, within the cylinder space 420, 520, gases such as chlorine gas 199 or hydrogen gas 299 may enter via the outlet supply lines 135, 235 and may accumulate within the top portion of the cylinder space 420, 520. From there, the accumulated gas may reposition the float sensors 430, 530 and may escape through the first and second dispense lines 170, 270, upon opening of a corresponding dispense valve 171, 172 of the first and second dispense lines 170, 270. In particular, the first outlet supply line 135 may traverse or extend towards the upper area of the first cylinder space 420, so as to allow gas (e.g., chlorine gas 199) to accumulate initially in the upper area of the first cylinder space 420 and exit the first dispense line 170. Similarly, the second outlet supply line 235 may traverse or extend towards the upper area of the second cylinder space 520, so as to allow gas (e.g., hydrogen gas 299) accumulate initially in the upper area of the second cylinder space 520 and exit the second dispense line 270. In other embodiments, the first outlet supply line 135 and second outlet supply line 235 may extend around the mid-section of the cylinder space 420, 520 to allow gas to exit and accumulate initially in the mid-area of the cylinder space 420, 520. Due to the communication of the liquid reactants at substantially the same pressure between the inner and outer areas of the open-bottom cylinders 410, 510, the open-bottom cylinders 410, 510 need not be constructed of high strength materials, and thus, may be constructed of other suitable materials such as polymers, composites, and the like.

FIG. 4 also shows that, due to the bottom openings of the open-bottom cylinders 410, 510, the fluid entering the first interior space 106 and second interior space 107 of the tank 150 may also enter within the cylinder space 420, 520 of the open-bottom cylinders 410, 510. Specifically, as shown in FIG. 4, the open-bottom cylinders 410, 510 may include bottom openings, which allow fluids within the tank 150 to enter or leave the open-bottom cylinders 410, 510. The first open-bottom cylinder 410, for instance, may accumulate and store chlorine gas 199, while the first interior space 106 of the tank 150 receives or stores the first liquid reactant 140 sodium chloride. As a result, sodium chloride may enter or leave the first cylinder space 420 through the bottom opening of the first open-bottom cylinder 410, and due to their differing densities (i.e., the first liquid reactant 140 sodium chloride generally has a higher density than chlorine gas 199), the chlorine gas 199 and first liquid reactant 140 sodium chloride may be physically separated. Similarly, the second open-bottom cylinder 510 may accumulate and store hydrogen gas 299, while the second interior space 107 of the tank 150 receives or stores the second liquid reactant 240, which may be water or water/sodium hydroxide liquid combination. As a result, the water and water/sodium hydroxide liquid combination may enter or leave the second cylinder space 520 through the bottom opening of the second open-bottom cylinder 510, and due to their differing densities (i.e., water or the liquid combination of water/sodium hydroxide generally has a higher density than hydrogen gas 299), the hydrogen gas 299 and second liquid reactant 240 may be physically separated.

Finally, embodiments of the first and second pumps 120,220 may be screw-pumps that allow fluid to enter and leave the tank 150. The accumulation or removal of fluid may increase or decrease the volume of the tank 150, thereby affecting the fluid pressure of the tank 150. Thus, because the fluid and gas may interact within the cylinder space 420, 520, pressure equilibrium within the open-bottom cylinders 410, 510 may be achieved—i.e., the liquid and gas may be at substantially the same pressure.

In operation, various embodiments of the brine electrolysis system 1000 may include a power supply 820 (shown in FIG. 8) that provides direct current voltage to the electrolysis stack assembly 310. The first and second submersible pumps 190, 290 may drive the first liquid reactant 140 (i.e., sodium chloride) and second liquid reactant 240 (e.g., water, water/sodium hydroxide liquid combination) into the electrolysis stack assembly 310 in order to electrochemically produce chlorine gas 199, hydrogen gas 299 and sodium hydroxide liquid. Intermediate chemical products of the reactions may be produced such as hydrogen ions, electrons, and chlorine gas 199. The hydrogen ions, which may be protons solvated by water in the form of hydronium, may be electrochemically reduced to hydrogen gas molecules and water 240 at the same time producing the hydroxide ion on one side of the ion-exchange membrane in the electrolysis stack assembly 310. The chlorine molecules may be drawn out, entrained by the sodium chloride liquid, through the first outlet supply line 135 and into the first cylinder space 420 of the open-bottom cylinder 410. There, the fluid pressure created by the sodium chloride and the gas pressure created by the chlorine gas molecules may also reach equilibrium, thereby dispensing the chlorine gas 199, separated by difference in density from the sodium chloride liquid, and stored within the cylinder space 420, ready for transfer through the first dispense line 170. Similarly, hydrogen molecules may be drawn out, entrained in the water (or water/sodium hydroxide liquid combination), through the second outlet supply line 235 and into the second cylinder space 520 of the open bottom cylinder 510. Within the second cylinder space 520, the fluid pressure created by the second liquid reactant 240 and the gas pressure created by the hydrogen gas molecules may reach equilibrium, thereby dispensing the hydrogen gas 299, separated by difference in density from the second liquid reactant 240, and stored within the cylinder space 520, ready for transfer through the second dispense line 270.

Figure 5:
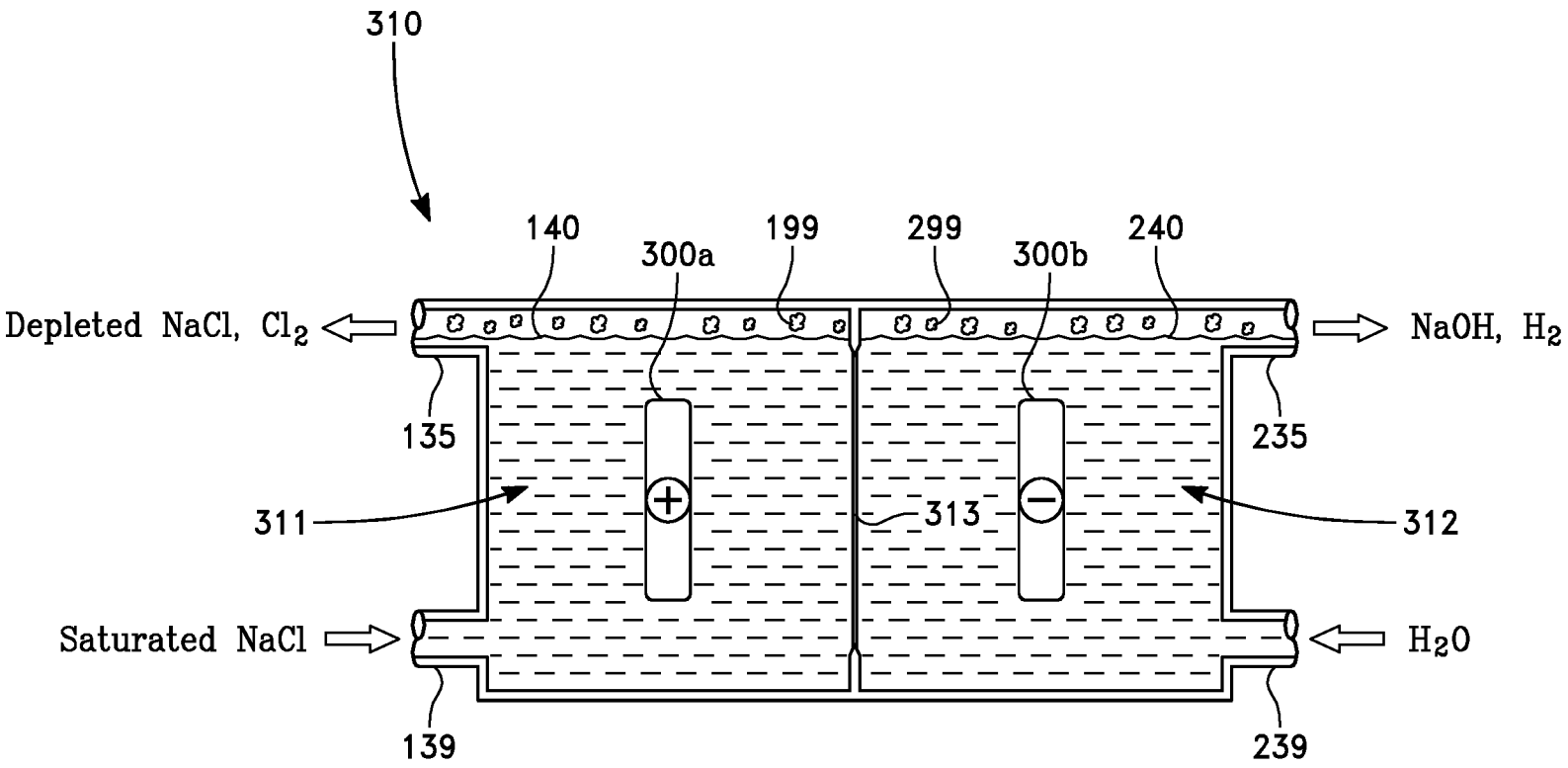
FIG. 5 illustrates a front cross section view of one embodiment of a chlor-alkali electrolysis stack from the chlor-alkali electrolysis stack assembly and shows the chlor-alkali process.

FIG. 5 illustrates a front cross section view of one embodiment of a chlor-alkali electrolysis stack from the chlor-alkali electrolysis stack assembly and shows the chlor-alkali process. As mentioned above, the electrolysis stack assembly 310 is preferably a chlor-alkali electrolysis stack assembly designed for performing a chlor-alkali process, which is the electrolysis process for sodium chloride solutions (e.g., brine, aqueous solution of NaCl) and water ($H_2O$) to produce chlorine gas 199 ($Cl_2$) and hydrogen ($H_2$) gas 299. The chlor-alkali process may have relatively high-energy consumption (e.g., around 2500 kWh of electricity per tonne of sodium hydroxide produced) and may also yield equivalent amounts of chlorine and sodium hydroxide (two moles of sodium hydroxide per mole of chlorine). Thus, for every mole of chlorine produced, one mole of hydrogen is generally produced.

In its basic configuration, the electrolysis stack assembly 310 or chlor-alkali electrolysis stack assembly may comprise one or more membrane cells configured to perform electrolysis on aqueous sodium chloride and water in a membrane cell. Sodium chloride stored in a first chamber 311 of the electrolysis stack assembly 310 may produce chlorine gas 199. Water stored in a second chamber 312 may produce hydrogen gas 299. Additional resulting products of the chlor-alkali process may also include sodium chloride (brine) of decreasing concentration in the first chamber 311 and sodium hydroxide (alkali) of increasing concentration in in the second chamber 312, both of which may outflow the electrolysis stack assembly 310.

Specifically, the first liquid reactant 140 (i.e., sodium chloride having a saturated concentration) may enter the first chamber 311 via first inlet 139. Here, the chloride ions ($Cl^-$) may be oxidized at anode 300*a*, thereby losing electrons to become chlorine gas 199:

$$2Cl^- \rightarrow Cl_2 + 2e^-$$

Additionally, counterion (Na+) within the first chamber 311 may freely flow across the ion-selective membrane 313 and into the second chamber 312. As a result, sodium chloride having a lower concentration may remain in the first chamber 311 and mix with newly added (saturated) sodium chloride entering the first chamber 311 via first inlet 139, resulting with a varying (decreasing) concentration of sodium chloride, as measured by the ionic conductivity meter 115.

At cathode 300*b*, the second liquid reactant 240 (e.g., water) entering the second chamber 312 via second inlet 239 may be reduced to sodium hydroxide ($OH^-$) and hydrogen gas 299. Specifically, hydronium ions in chemical equilibrium with the water molecules may be reduced by the electrons provided by the electrolytic current, to hydrogen gas 299, releasing hydroxide ions into the solution:

$$2H_2O + 2e- \rightarrow H_2 + 2OH^-$$

Counterion sodium ions (Na+) passing the ion-permeable ion exchange membrane 313 at the center of the membrane cell may balance the charge with the hydroxide ions to produce sodium hydroxide (NaOH) liquid (aqueous). Therefore, the overall reaction for the electrolysis of brine may be:

$$2NaCl + 2H_2O \rightarrow Cl_2 + H_2 + 2NaOH$$

Notably, within the second chamber 312, sodium hydroxide (NaOH) may mix with newly added water, resulting with a varying concentration of sodium hydroxide (NaOH) (mixing with water decreases the concentration of NaOH), as measured by the pH meter 215.

Accordingly, the net process of the chlor-alkali electrolysis process of an aqueous solution of NaCl may be chlorine gas 199, hydrogen gas 299, decreasing concentration of sodium chloride, and increasing concentration of sodium hydroxide, concentrations that may be modulated by inflow of additional sodium chloride (increasing the concentration of sodium chloride) and water (decreasing the concentration of NaOH). In various embodiments, the ionic conductivity meter 115 may measure the depleted concentration of sodium chloride with entrained chlorine gas 199 within the first chamber 311, and as a result, may allow the depleted sodium chloride to exit or outflow the electrolysis stack assembly 310 via the first outlet 135. Also, given that the first outlet 135 may be physically above first inlet 139, chlorine gas 199 may be separated from the depleted sodium chloride via density and thus may also exit the first outlet 135, as shown in FIG. 5. Similarly, the pH meter 215 may measure the increased concentration of sodium hydroxide with entrained hydrogen gas 299 within the second chamber 312, and as a result, may allow the saturated sodium hydroxide (NaOH) to exit or outflow the electrolysis stack assembly 310 via the second outlet 235. Given that second outlet 235 may be physically above second inlet 239, the hydrogen gas 299 may be separated from the saturated sodium hydroxide via density and thus may also exit the second outlet 235, as shown in FIG. 5.

Figure 6:
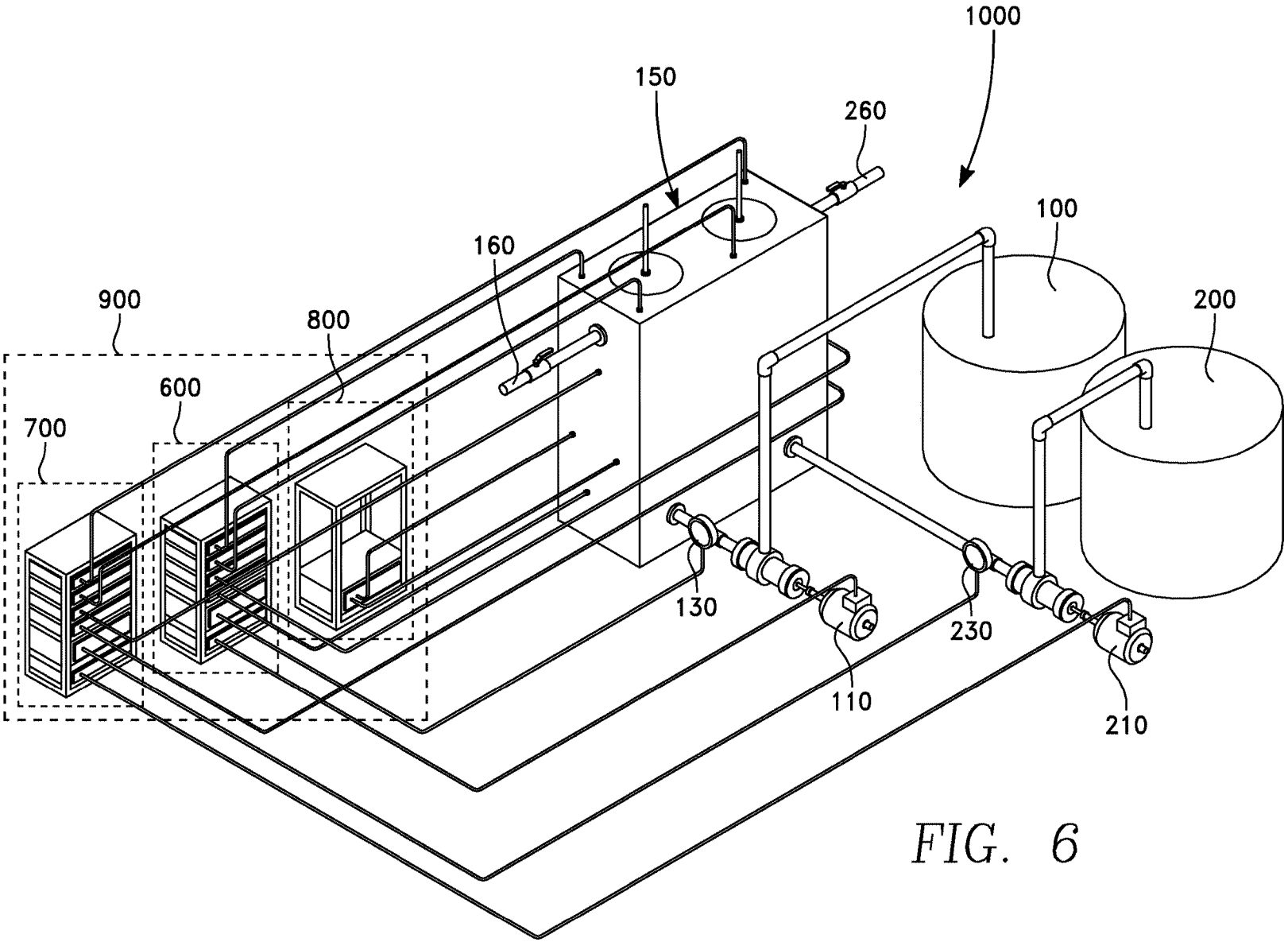
FIG. 6 illustrates a perspective view of one embodiment of the brine electrolysis system and shows the controller for regulating the operation of the brine electrolysis system.

FIG. 6 illustrates a perspective view of one embodiment of the brine electrolysis system 1000 and shows the controller 900 for regulating the operation of the brine electrolysis system 1000. The controller 900 may comprise a brine process controller 600 and an alkali process controller 700 (one for each interior space 106,107 of the tank 150), and a power supply controller 800. The brine process controller 600 and an alkali process controller 700 may be feedback controllers that regulate the concentration of the first liquid reactant 140 (i.e., sodium chloride) and second liquid reactant 240 (e.g., water, water/sodium hydroxide) within the tank 150 as well as chlorine gas 199 and hydrogen gas 299 present within the open-bottomed cylinders 410, 510. In particular, the controller 600 may obtain sodium chloride concentration readings from the ionic conductivity meter 115 and the alkali process controller 700 may obtain sodium hydroxide concentration reading from the pH meter 215 and use those concentration readings as a feedback signal to the controller 900. Based on these concentration readings, inter alia, the controller 900 may transmit control signals to the first and second pumps 120, 220 via 600, 700.

By way of example, in an embodiment when the first pump 120 is a screw-pump, to regulate the flow of sodium chloride by the first pump 120, a first variable frequency drive (VFD) controller 620 (shown in FIG. 8) may obtain the sodium chloride concentration readings from the ionic conductivity meter 115 and thus control the sodium chloride concentration of the first interior space 106 of the tank 150. In this embodiment, if the sodium chloride concentration falls below a predetermined lower limit, the outflow valve 161 of the first outflow line 160 may open to release the depleted sodium chloride within the tank 150. The first VFD controller 620 may also increase the ionic concentration within the first interior space 106, thereby operating the first pump 120 in the forward direction via the first motor 110 and replacing/compressing fluid into the first interior space 106. Various control algorithms may be implemented to regulate the sodium chloride concentration using the ionic concentration readings from the ionic conductivity meter 115. Accordingly, the ionic conductivity meter 115 may monitor and measure the sodium chloride concentration within the first interior space 106 of the tank 150, thereby serving as a suitable proxy for regulating the sodium chloride concentration within the first interior space 106 of the tank 150 via the first pump 120.

Similarly, in the same embodiment, when the second pump 220 is likewise a screw-pump, to regulate the flow of water by the second pump 220, a second VFD controller 720 (shown in FIG. 8) may obtain the sodium hydroxide concentration readings from the pH meter 215 and thus control the sodium hydroxide concentration within the second interior space 107 of the tank 150. In this embodiment, if the sodium hydroxide concentration rises above a predetermined lower limit, the outflow valve 261 of the second outflow line 260 may open to release the sodium hydroxide within the tank 150. The second VFD controller 720 may also decrease the sodium hydroxide concentration within the second interior space 107, thereby operating the second pump 220 in the forward direction via the second motor 210 and replacing/compressing water into the second interior space 107. Various control algorithms may be implemented to regulate the sodium hydroxide concentration using the ionic concentration readings from the pH meter 215. Accordingly, the pH meter 215 may monitor and measure the sodium hydroxide concentration within the second interior space 107 of the tank 150, thereby serving as a suitable proxy for regulating the sodium hydroxide concentration within the second interior space 107 of the tank 150 via the second pump 220.

Figure 7:
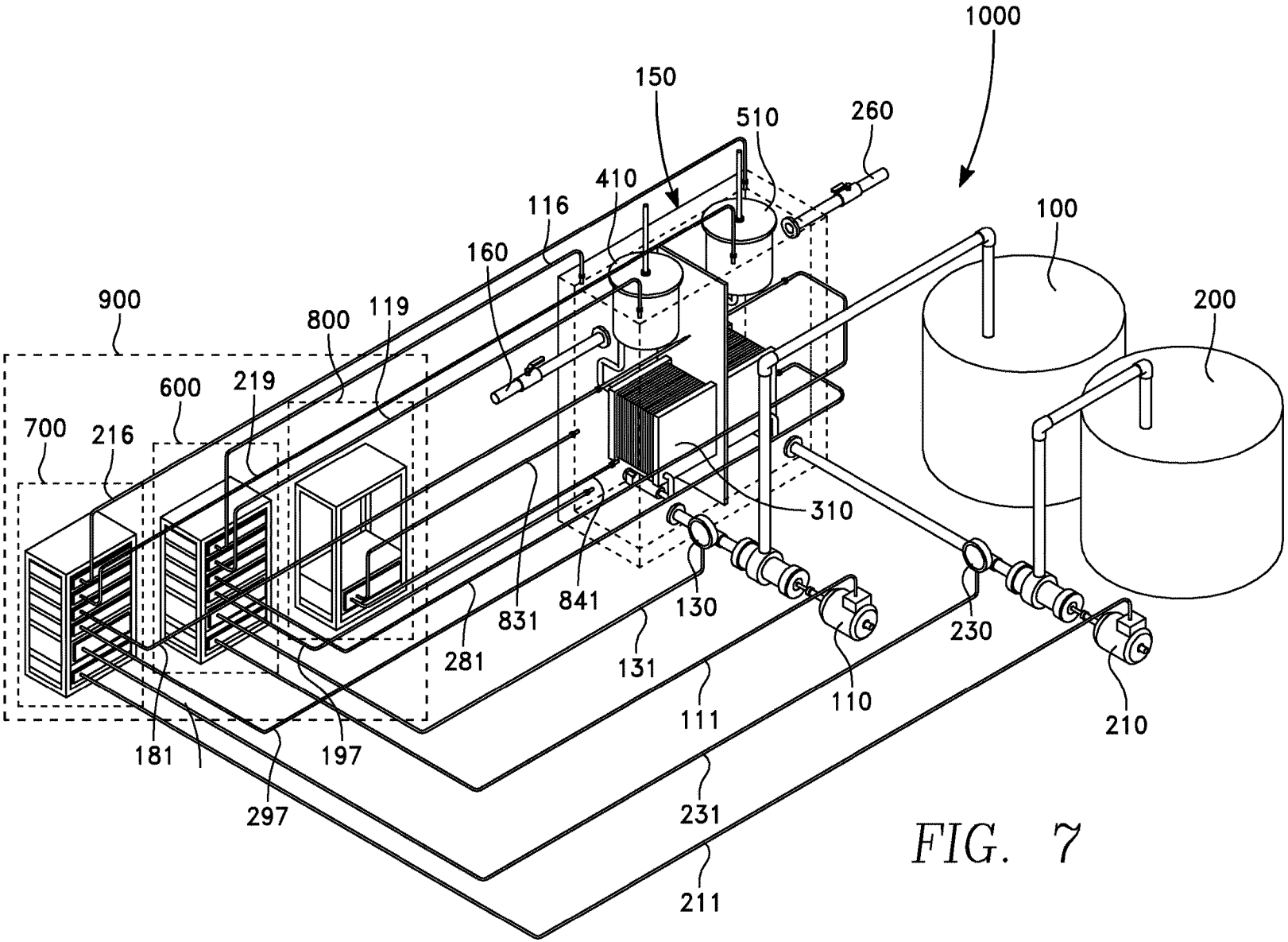
FIG. 7 illustrates a perspective view of one embodiment of the brine electrolysis system and shows in detail control and feedback lines coupled between the controller and various parts of the brine electrolysis system.

FIG. 7 illustrates a perspective view of one embodiment of the brine electrolysis system 1000 and shows in detail control and feedback lines coupled between the controller 900 and other parts of the brine electrolysis system 1000. As shown in FIG. 7, embodiments of the control and feedback lines for the brine electrolysis system 1000 may include: ionic conductivity feedback lines 116, 216, temperature lines 119, 219, flow rate lines 197, 297, power supply lines 831, 841, deflection switch lines 181, 281, VFD control lines 111, 211, and pressure gauge lines 131, 231.

The ionic conductivity feedback lines 116, 216 may allow transmission of ionic conductivity measurement readings obtained from the tank 150 to the brine process controller 600 and alkali process controller 700 and from there to controller 900. In particular, ionic conductivity feedback line 116 preferably allows transmission of the derived sodium chloride concentration readings obtained from the first interior space 106 of the tank 150 via the ionic conductivity meter 115 to the brine process controller 600. Ionic conductivity feedback line 216, on the other hand, preferably allows transmission of the derived sodium hydroxide concentration readings obtained from the second interior space 107 of the tank 150 via the pH meter 215 to the alkali process controller 700.

The temperature lines 119, 219 may allow transmission of temperature readings obtained from the tank 150 to the controller 900. In particular, temperature line 119 preferably allows transmission of temperature readings obtained from the first interior space 106 of the tank 150 via the brine temperature gauge 118 to the brine process controller 600. Temperature line 219, on the other hand, preferably allows transmission of temperature readings obtained from the second interior space 107 of the tank 150 via the alkali temperature gauge 218 to the alkali process controller 700.

The flow rate lines 197, 297 preferably provide volumetric flow rate readings obtained from the first and second submersible pumps 190, 290 within the tank 150 to the controller 900. In particular, flow rate line 197 preferably allows transmission of volumetric flow rate measurements from the first interior space 106 of the tank 150 via the brine submersible pump flow rate gauge 196 to the brine process controller 600. Flow rate line 297, on the other hand, preferably allows transmission of volumetric flow rate measurements from the second interior space 107 of the tank 150 via the alkali submersible pump flow rate gauge 296 to the alkali process controller 700.

The power supply lines 831, 841 preferably provide DC power transmission to the controller 900 from the power supply controller 800 to the brine electrolysis system 1000. In particular, power supply line 831 preferably provides a positive DC connection to the positive lead flange 830 of the tank 150, whereas power supply 841 provides a negative DC connection to the negative lead flange 840 of the tank 150. Positive and negative lead flanges 830, 840 are preferably in electrical communication with the electrolysis stack assembly 310.

The deflection switch lines 181, 281 preferably provide transmission of diaphragm deflection as result of over-fill readings obtained from the first and second deflection switches 180, 280, respectively, to the brine process controller 600 and electrolysis process controller 700, respectively, and thus to the overall controller 900. In particular, first deflection switch line 181 preferably allows transmission of diaphragm deflection readings obtained from the second interior space 107 of the tank 150 via the first deflection switch 180 to the alkali process controller 700 as the result of over-fill of the second liquid reactant 240 (e.g., water, water/sodium hydroxide liquid combination). Second deflection switch line 281, on the other hand, preferably allows transmission of diaphragm deflection readings obtained from the first interior space 106 of the tank 150 via the second deflection switch 280 to the brine process controller 600 as the result of over-fill of the first liquid reactant 140 (i.e., sodium chloride).

The VFD control lines 111, 211 preferably provide control signal transmission obtained from the controller 900 to the first and second motors 110, 210. In particular, VFD control line 111 preferably provides control signal transmission obtained from the brine process controller 600 to control the first motor 110. VFD control line 211 preferably provides control signal transmission obtained from the alkali process controller 700 to control the second motor 210.

The pressure gauge lines 131, 231 preferably provide transmission of pressure readings obtained from the first and second pressure gauges 130, 230, respectively, to the controller 900. In particular, pressure gauge line 131 preferably allows transmission of pressure readings obtained from the first interior space 106 of the tank 150 via the first pressure gauge 130 to the brine process controller 600. Pressure gauge line 231, on the other hand, preferably allows transmission of pressure readings obtained from the second interior space 107 of the tank 150 via the second pressure gauge 230 to the alkali process controller 700.

Figure 8:
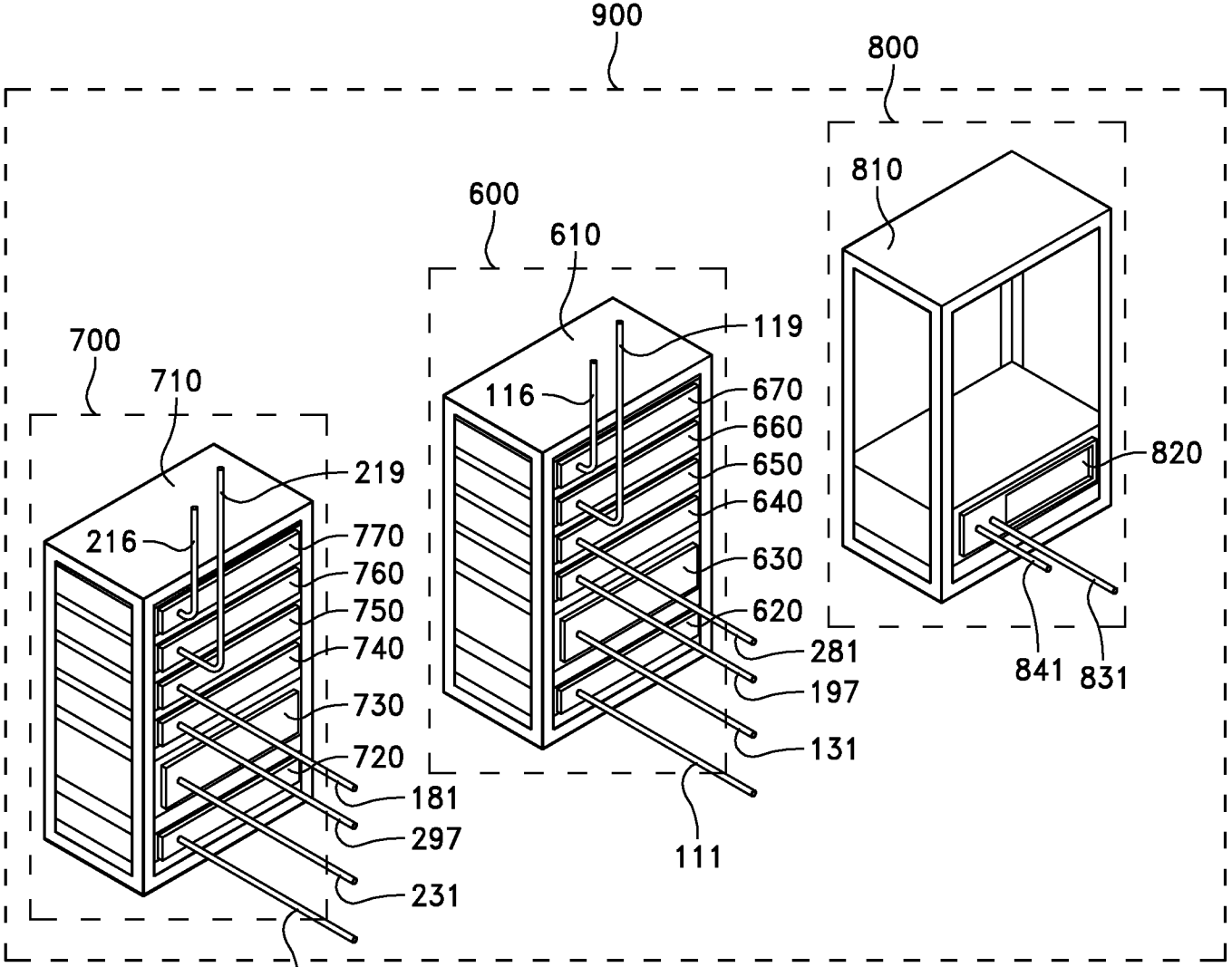
FIG. 8 illustrates a perspective view of one embodiment of the controller in more detail along with the various control and feedback lines connected therewith.

FIG. 8 illustrates a perspective view of one embodiment of the controller 900 in more detail along with the various control and feedback lines connected therewith. As shown in FIG. 8, one embodiment of the controller 900 may comprise: a brine process controller 600, alkali process controller 700, and power supply controller 800. FIG. 8 also shows that the brine process controller 600 may comprise: a cabinet 610, first VFD controller 620, brine pressure meter 630, first flow rate meter 640, first diaphragm deflection switch meter 650, brine temperature meter 660, and brine concentration meter 670. Additionally, the alkali process controller 700 may comprise: a cabinet 710, second VFD controller 720, alkali pressure meter 730, second flow rate meter 740, second diaphragm deflection switch meter 750, alkali temperature meter 760, and alkali concentration meter 770. Finally, the power supply controller 800 may comprise a cabinet 810 and power supply 820.

The cabinets 610, 710, 810 may be storage units that hold standard rack-mounted units such as server racks or the like and may be capable of holding and securing various types of electronics and instrumentation equipment Additionally, embodiments of each instrumentation unit may be bolted to the side frames of the cabinet 610, 710, 810 and may have a height of a standard rack-mounted device of 1.75" (1 U) from top to bottom.

The first and second VFD controllers 620, 720 may be adjustable-speed drives used to control or regulate the motor speed and torque of the first and second motors 110, 210, respectively. In particular, the first and second VFD controllers 620, 720, which may be in electrical communication with the first and second motors 110, 210 via VFD control lines 111, 211, may vary the motor input frequency and voltage in order to control the speed of the first and second motors 110, 210. Thus, the VFD controllers 620, 720 may regulate the amount of fluid entering each interior spaces 106, 107 of the tank 105. As discussed above, the motor input frequency may be adjusted based on the ionic conductivity measurements obtained by the ionic conductivity meter 115 and pH meter 215. Additionally, in an embodiment where the main pump 110 is a screw-pump, the VFD 410 may toggle the rotational direction of the first and second motors 110, 210 between forward and reverse and adjust the speed of the rotation. In this manner, the first and second pumps 120, 220 may regulate the ionic concentration by adding liquid reactants into the tank interior spaces 106,107 or removing liquid reactants from the tank interior spaces 106, 107.

The brine pressure meter 630 and alkali pressure meter 730 may be in communication with the first and second pressure gauges 130, 230, respectively, via pressure gauge lines 131, 231 and are preferably instruments used for collecting pressure readings or data from the first and second pressure gauges 130, 230. The first and second pressure gauges 130, 230 preferably monitor the fluid pressure readings for the interior spaces 106, 107 of the tank 105 and may provide feedback to the first and second VFD controllers 620, 720 to regulate pressure within the tank 105.

The first and second flow meter 640, 740 may be in communication with the brine submersible pump flow rate gauge 1% and the alkali submersible pump flow rate gauge 296, respectively, via flow rate lines 197, 297 and are preferably instruments that collect volumetric flow rate measures of the tank 150. Based on the volumetric flow rates, the brine process controller 600 and alkali process controller 700 may adjust the pumping action of the first and second submersible pumps 190, 290 to control the amount of heat generated by the electrolysis stack assembly 310. The brine process controller 600 and alkali process controller 700 may also inactivate the electrolysis stack assembly 310 when the liquid reactants are outside the manufacturer specification of temperature operating range.

The first and second diaphragm deflection switch meters 650, 750 may be in communication with the first and second deflection switches 180, 280 via deflection switch lines 181, 281 and may be configured for determining whether fluid or volume has reached a certain threshold within the first and second interior spaces 106, 107 of the tank 150. Given that the first and second deflection switches 180, 280 may determine whether a fluid has reached a certain volume within the tank 150, these fluid measurements may trigger the controller 900 to provide feedback control to the first and second motors 110, 210, and as a result, the first and second pumps 120, 220. In this manner, the brine electrolysis system 1000 may maintain volume of the liquid reactants within the tank 150.

The brine temperature meter 660 and alkali temperature meter 760 may be in communication with the brine temperature gauge 118 and alkali temperature gauge 218, respectively, via temperature lines 119, 219, and are preferably instruments used for collecting temperature measurements of the liquid reactants within the tank 150. Specifically, the brine temperature meter 660 may obtain temperature measurements of sodium chloride within the first interior space 106 of the tank 150 via the brine temperature gauge 118. The alkali temperature meter 760, on the other hand, may obtain temperature measurements of water within the second interior space 107 of the tank 150 via the alkali temperature gauge 218. Importantly, not shown, the liquid reactant brine and water may be refrigerated in the first and second liquid storage tanks 100, 200 to reduce absolute temperature rise within the first and second interior spaces 106,107 upon operation of the electrolysis stack assembly 310.

The brine concentration meter 670 and alkali concentration meter 770 may be in communication with the ionic conductivity meter 115 and pH meter 215, respectively, via ionic concentration feedback lines 116, 216, and are preferably instruments used for collecting ionic conductivity measurements converted to concentration readings of the liquid reactants within the tank 150. Specifically, the brine concentration meter 670 may obtain ionic conductivity measurements of sodium chloride for conversion to concentration reading within the first interior space 106 of the tank 150 via the ionic conductivity meter 115. The alkali concentration meter 770, on the other hand, may obtain ionic conductivity measurements for conversion to concentration readings of sodium hydroxide within the tank 150 within the second interior space 107 of the tank 150 via the pH meter 215.

Finally, the power supply 820 may be device or component that supplies power to the brine electrolysis system 1000. The power supply 820 is preferably coupled to the electrolysis stack assembly 310 via the power supply lines 831, 841 and positive and negative lead flanges 830,840 for converting the supplied power to the correct voltage and current, in applying the correct potential difference across the end plates of the electrolysis stack assembly 310.

The foregoing description of the embodiments of the brine electrolysis system for producing pressurized chlorine and hydrogen gases has been presented for the purposes of illustration and description. While multiple embodiments are disclosed, other embodiments will become apparent to those skilled in the art from the above detailed description. As will be realized, these embodiments are capable of modifications in various obvious aspects, all without departing from the spirit and scope of the present disclosure. Accordingly, the detailed description is to be regarded as illustrative in nature and not restrictive.

Although embodiments of the brine electrolysis system are described in considerable detail, other versions are possible. Therefore, the spirit and scope of the appended claims should not be limited to the description of versions included herein.

Except as stated immediately above, nothing which has been stated or illustrated is intended or should be interpreted to cause a dedication of any component, step, feature, object, benefit, advantage, or equivalent to the public, regardless of whether it is or is not recited in the claims. The scope of protection is limited solely by the claims that now follow, and that scope is intended to be broad as is reasonably consistent with the language that is used in the claims. The scope of protection is also intended to be broad to encompass all structural and functional equivalents.

What is claimed as new and desired to be protected by Letters Patent is set forth in the appended claims:

1. A brine electrolysis system, comprising:

a tank having first and second interior spaces separated by a diaphragm for storing first and second liquid reactants respectively;

first and second pumps in fluid communication with said first and second interior spaces, respectively;

first and second open-bottom cylinder disposed within said tank and having first and second cylindrical spaces, respectively;

first and second dispense lines disposed outside said tank and in fluid communication with said first and second cylindrical spaces, respectively;

first and second submersible pumps disposed within said first and second interior spaces, respectively, and configured to pump first and second liquid reactants; and an electrolysis stack assembly traversing across said first and second interior spaces of said tank and sealably through said diaphragm.

2. The brine electrolysis system recited in claim 1, characterized in that said electrolysis stack assembly comprises:

one or more electrolysis stacks for creating first and second gases based on said first and second liquid reactants, respectively;

first and second inlets in fluid communication with said first and second submersible pumps, respectively;

a first outlet supply line traversing into said first cylindrical space through a first bottom opening of said first open-bottom cylinder for releasing said first gas into said first cylindrical space; and a second outlet supply line traversing into said second cylindrical space through a second bottom opening of said second open-bottom cylinder for releasing said second gas into said second cylindrical space.

3. The brine electrolysis system recited in claim 2, characterized in that said first and second liquid reactants are respectively a sodium chloride and a water; and wherein said first and second gases are a chlorine gas and a hydrogen gas, respectively.

4. The brine electrolysis system recited in claim 1, characterized in that said electrolysis stack assembly is a chlor-alkali electrolysis stack assembly.

5. The brine electrolysis system recited in claim 2, wherein said diaphragm is constructed of an ion-selective membrane configured to permit a counterion (Na+) to flow across said diaphragm from said first interior space to said second interior space.

6. The brine electrolysis system recited in claim 2, further comprising first and second liquid storage tanks in fluid communication with first and second inlets of said first and second pumps, respectively; and first and second motors operably coupled to said first and second pumps, respectively.

7. The brine electrolysis system recited in claim 6, further comprising a brine process controller and an ionic conductivity meter;

wherein said ionic conductivity meter is configured to measure a sodium chloride concentration within said first interior space of said tank; and wherein said brine process controller is operably coupled to said first motor and said ionic conductivity meter and regulates said sodium chloride concentration within said first interior space based on said sodium chloride concentration measurements.

8. The brine electrolysis system recited in claim 6, further comprising an alkali process controller and a pH meter;

wherein said pH meter is configured to measure a sodium hydroxide concentration within said second interior space of said tank; and wherein said alkali process controller is operably coupled to said second motor and said pH meter and regulates said sodium hydroxide concentration within said second interior space based on said sodium hydroxide concentration measurements.

9. A brine electrolysis system, comprising:

a tank having first and second interior spaces separated by a diaphragm;

first and second pumps in fluid communication with said first and second interior spaces of said tank, respectively;

a first open-bottom cylinder disposed within said first interior space and comprising:

a first cylindrical body having a first cylindrical space in fluid communication with said first interior space of said tank; and a first float sensor adapted to raise and lower via buoyancy;

a second open-bottom cylinder disposed within said second interior space and comprising:

a second cylindrical body having a second cylindrical space in fluid communication with said second interior space of said tank; and a second float sensor adapted to raise and lower via buoyancy;

first and second dispense lines disposed outside said tank and respectively coupled to said first and second open-bottom cylinders, such that said first and second dispense lines are in fluid communication with said first and second cylindrical spaces, respectively;

first and second submersible pumps disposed within said first and second interior spaces, respectively, and respectively configured to pump a sodium chloride and a water; and a chlor-alkali electrolysis stack assembly traversing across said first and second interior spaces of said tank and sealably through said diaphragm.

10. The brine electrolysis system recited in claim 9, characterized in that said chlor-alkali electrolysis stack assembly comprises:

one or more chlor-alkali electrolysis stacks for creating a chlorine gas and a hydrogen gas based on said sodium chloride and said water, respectively;

first and second inlets in fluid communication with said first and second submersible pumps, respectively;

a first outlet supply line traversing into said first cylindrical space through a first bottom opening of said first open-bottom cylinder for releasing said chlorine gas into said first cylindrical space; and a second outlet supply line traversing into said second cylindrical space through a second bottom opening of said second open-bottom cylinder for releasing said hydrogen gas into said second cylindrical space.

11. The brine electrolysis system recited in claim 9, further comprising first and second liquid storage tanks in fluid communication with first and second inlets of said first and second pumps, respectively, wherein said first and second liquid storage tanks store said sodium chloride and said water, respectively; and first and second motors operably coupled to said first and second pumps, respectively.

12. The brine electrolysis system recited in claim 11, further comprising a brine process controller and an ionic conductivity meter;

wherein said ionic conductivity meter is configured to measure a sodium chloride concentration within said first interior space of said tank; and wherein said brine process controller comprises a first variable frequency drive (VFD) operably coupled to said first motor for regulating said sodium chloride concentration within said first interior space based on said sodium chloride concentration measurements.

13. The brine electrolysis system recited in claim 11, further comprising an alkali process controller and a pH meter;

wherein said pH meter is configured to measure a sodium hydroxide concentration within said second interior space of said tank; and wherein said alkali process controller comprises a second VFD operably coupled to said second motor for regulating said sodium hydroxide concentration within said second interior space based on said sodium hydroxide concentration measurements.

14. The brine electrolysis system recited in claim 9, wherein said diaphragm is constructed of an ion-selective membrane configured to permit a counterion (Na+) to flow across said diaphragm from said first interior space to said second interior space.

15. A brine electrolysis system, comprising:

a tank having first and second interior spaces separated by a diaphragm;

a first rotary screw pump having a first outlet that is sealably coupled to a first opening of said tank and in fluid communication with said first interior space;

a second rotary screw pump having a second outlet that is sealably coupled to a second opening of said tank and in fluid communication with said second interior space;

a first open-bottom cylinder disposed within said first interior space and comprising:

a first cylindrical body having a first cylindrical space in fluid communication with said first interior space of said tank; and a first float sensor adapted to raise and lower via buoyancy;

a second open-bottom cylinder disposed within said second interior space and comprising:

a second cylindrical body having a second cylindrical space in fluid communication with said second interior space of said tank; and a second float sensor adapted to raise and lower via buoyancy;

a first dispense line disposed outside said tank and sealably coupled to said first open-bottom cylinder, such that said first dispense line is in fluid communication with said first cylindrical space;

a second dispense line disposed outside said tank and sealably coupled to said second open-bottom cylinder, such that said second dispense line is in fluid communication with said second cylindrical space;

a first submersible pump disposed within said first interior space for pumping a sodium chloride;

a second submersible pump disposed within said second interior space for pumping a water; and a chlor-alkali electrolysis stack assembly traversing across said first and second interior spaces of said tank and sealably through said diaphragm, said chlor-alkali electrolysis stack assembly, comprising:

one or more chlor-alkali electrolysis stacks for creating a chlorine gas and a hydrogen gas based on said sodium chloride and said water, respectively;

first and second inlets in fluid communication with said first and second submersible pumps, respectively;

a first outlet supply line traversing into said first cylindrical space through a first bottom opening of said first open-bottom cylinder for releasing said chlorine gas into said first cylindrical space; and a second outlet supply line traversing into said second cylindrical space through a second bottom opening of said second open-bottom cylinder for releasing said hydrogen gas into said second cylindrical space.

16. The brine electrolysis system recited in claim 15, further comprising first and second liquid storage tanks in fluid communication with first and second inlets of said first and second rotary screw pumps, respectively; and wherein said first and second liquid storage tanks respectively store said sodium chloride and said water.

17. The brine electrolysis system recited in claim 16, further comprising first and second motors operably coupled to said first and second rotary screw pumps, respectively.

18. The brine electrolysis system recited in claim 17, further comprising a brine process controller and an ionic conductivity meter;

wherein said ionic conductivity meter is configured to measure a sodium chloride concentration within said first interior space of said tank; and wherein said brine process controller comprises a first VFD operably coupled to said first motor for regulating said sodium chloride concentration within said first interior space based on said sodium chloride concentration measurements.

19. The brine electrolysis system recited in claim 18, further comprising an alkali process controller and a pH meter;

wherein said pH meter is configured to measure a sodium hydroxide concentration within said second interior space of said tank; and wherein said alkali process controller comprises a second VFD operably coupled to said second motor for regulating said sodium hydroxide concentration within said second interior space based on said sodium hydroxide concentration measurements.

20. The brine electrolysis system recited in claim 15, wherein said diaphragm is constructed of an ion-selective membrane configured to permit a counterion (Na+) to flow across said diaphragm from said first interior space to said second interior space.

* * * * *